US012345444B2

(12) United States Patent
Liu

(10) Patent No.: US 12,345,444 B2
(45) Date of Patent: Jul. 1, 2025

(54) PERIPHERAL WIND OUTLETS DEVICE AND A MATRIX WIND GENERATION SYSTEM USING THE SAME

(71) Applicant: Rixon Tech. Co., Ltd., Zhubei (TW)

(72) Inventor: Chih-Wei Liu, Hsinchu (TW)

(73) Assignee: RIXON TECH. CO., LTD., Zhubei (TW)

( * ) Notice: Subject to any disclaimer, the term of this patent is extended or adjusted under 35 U.S.C. 154(b) by 509 days.

(21) Appl. No.: 17/579,275

(22) Filed: Jan. 19, 2022

(65) Prior Publication Data

US 2022/0252288 A1 Aug. 11, 2022

(30) Foreign Application Priority Data

Feb. 8, 2021 (TW) ..... 110104729

(51) Int. Cl.
*F24F 9/00* (2006.01)

(52) U.S. Cl.
CPC ..... *F24F 9/00* (2013.01)

(58) Field of Classification Search
CPC ..... F24F 9/00
USPC ..... 454/192
See application file for complete search history.

(56) References Cited

U.S. PATENT DOCUMENTS 3,018,712 A * 1/1962 Wacker ..... F24F 9/00 454/192
3,097,587 A * 7/1963 Kurek ..... F24F 7/10 454/192
3,726,203 A * 4/1973 Lindestrom ..... A61G 10/02 55/467
5,830,058 A * 11/1998 Rosjo ..... F24F 3/163 454/192

(Continued)

*Primary Examiner* — Avinash A Savani
*Assistant Examiner* — Dana K Tighe
(74) *Attorney, Agent, or Firm* — MUNCY, GEISSLER, OLDS & LOWE, P.C.

(57) ABSTRACT

A peripheral wind outlets device and a matrix wind generation system is disclosed, which is disposed on a protected space, and comprises an air supply matrix and an air exhaust matrix. The air supply matrix is composed by a plurality of peripheral wind outlets devices, disposed on a top surface of the protected space. The air exhaust matrix is composed by a plurality of peripheral air exhaust devices, disposed on a bottom surface of the protected space. The peripheral wind outlets devices and the peripheral air exhaust devices are arranged facing each other, and each has an air supply device coordinate or an air exhaust device coordinate correspondingly, the peripheral wind outlets devices and the peripheral air exhaust devices receive a wind field control command from a wind field control system, the wind field control command includes at least one first range circle and selected at least one of the peripheral wind outlets devices and at least one of the peripheral air exhaust devices located within, to make air-supply wind speeds of the at least one of the peripheral wind outlets devices are different from the air- (Continued)

supply wind speeds of the peripheral wind outlets devices not located within the first range circle, air-exhaust wind speeds of the at least one of the peripheral air exhaust devices are different from the air-exhaust wind speeds of the peripheral air exhaust devices not located within the first range circle.

2 Claims, 27 Drawing Sheets

(56) References Cited

U.S. PATENT DOCUMENTS

| | | | | |
|---|---|---|---|---|
| 6,110,244 | A * | 8/2000 | Wood | F24F 3/163<br>454/192 |
| 8,376,822 | B1 * | 2/2013 | Smith | A61N 7/02<br>454/188 |
| 10,962,246 | B2 * | 3/2021 | Bromley | F24F 3/163 |
| 2009/0291627 | A1 * | 11/2009 | Zimmermann | F24F 9/00<br>700/275 |

* cited by examiner

PERIPHERAL WIND OUTLETS DEVICE AND A MATRIX WIND GENERATION SYSTEM USING THE SAME

BACKGROUND

1. Technical Field

The disclosure is related to a wind field system, and more particularly to a peripheral wind outlets device and a matrix wind generation system using the same.

2. Background

Coronavirus disease 2019 (abbreviated as, COVID-19) is one of the most fatal epidemics in human history, and it has infected more than 100 million people. Similar to cold virus, COVID-19 is a kind of disease transmitted through the respiratory tract, so it is an epidemic likely causing large-scale infection.

The large-scale global spread of COVID-19 has caused to major problems such as the strict control of global infectious diseases, the collapse of the medical system, and the impact of the economic system. Because of responsibility for treating COVID-19 patients, the medical system has become the most important place for infectious disease control. Therefore, due to the high infectiousness of the COVID-19, it is a priority to allocate COVID-19 patients in the negative pressure ward to prevent the virus in the ward from spreading to other places outside the ward. In addition, the medical workers who have contact with COVID-19 patient also must wear protective clothing to prevent from being infected.

However, the ward with negative pressure, the standard dressing procedure and disinfection procedure of protective clothing are still impossible to absolutely prevent the medical workers from being infected during the treatment of COVID-19 patients. For example, the cluster infection caused by the COVID-19 No. 812 patient in the Taoyuan Hospital, Ministry of Health and Welfare is that the doctor was infected during the diagnosis and treatment of patient. Therefore, there is a considerable room for improvement in the existing infectious disease control mode using protective clothing and the negative pressure ward.

Therefore, how to configure an active air protection system for medical workers, or other related personnel in infectious disease control wards or other applications where a user protection is required, to cover the medical worker and related personnel with positive pressure to form a protective barrier to further reduce the risk of medical workers and the related personnel from being infected by the patients in the infection control wards or virus or bacteria in or other application places, has become an important issue for the development of active protection technology in the industry.

SUMMARY

The disclosure provides a peripheral wind outlets device and a matrix wind generation system using the same to make the air flow rate of the space, where the person is located, different from the air flow rate of other space, so as to produce positive pressure or negative pressure on the space where the person is located, thereby achieving the special technical effect of providing air protection barrier on the person.

In order to achieve the above-mentioned objective, the disclosure provides a matrix wind field generation system having peripheral wind outlets devices, which is disposed on a protected space, and comprises an air supply matrix and an air exhaust matrix. The air supply matrix is composed by a plurality of peripheral wind outlets devices, disposed on a top surface of the protected space. The air exhaust matrix is composed by a plurality of peripheral air exhaust devices, disposed on a bottom surface of the protected space. The peripheral wind outlets devices and the peripheral air exhaust devices are arranged facing each other, and each has an air supply device coordinate or an air exhaust device coordinate correspondingly, the peripheral wind outlets devices and the peripheral air exhaust devices receive a wind field control command from a wind field control system, the wind field control command includes at least one first range circle and selected at least one of the peripheral wind outlets devices and at least one of the peripheral air exhaust devices located within, to make air-supply wind speeds of the at least one of the peripheral wind outlets devices are different from the air-supply wind speeds of the peripheral wind outlets devices not located within the first range circle, air-exhaust wind speeds of the at least one of the peripheral air exhaust devices are different from the air-exhaust wind speeds of the peripheral air exhaust devices not located within the first range circle.

The disclosure further provides a peripheral wind outlets device, which is disposed on a top surface of a protected space, and comprises an air inlet, a fan, a motor, a plurality of throttles, a plurality of screens, a plurality of air outlets and a controller. The air inlet is connected to a ventilation duct. The fan is disposed facing the air inlet. The motor is configured to drive the fan to rotate to input air into the air inlet. The throttles are disposed on a blowing side of the fan and configured to control an air supply volume of the fan. The screens are disposed on blowing sides of the throttles and configured to uniform the air supply volume of the throttles. The air outlets are disposed on the peripheral of blowing sides of the screens and facing the protected space. The controller is connected to the motor and the throttles, after receiving a wind field control command from a wind field control system, the controller adjusts a rotation speed of the motor and/or sizes of the at least one throttle, to adjust air-supply wind speeds.

BRIEF DESCRIPTION OF THE DRAWINGS

The structure, operating principle and effects of the disclosure will be described in detail by way of various embodiments which are illustrated in the accompanying drawings.

DETAILED DESCRIPTION

Figure 1:
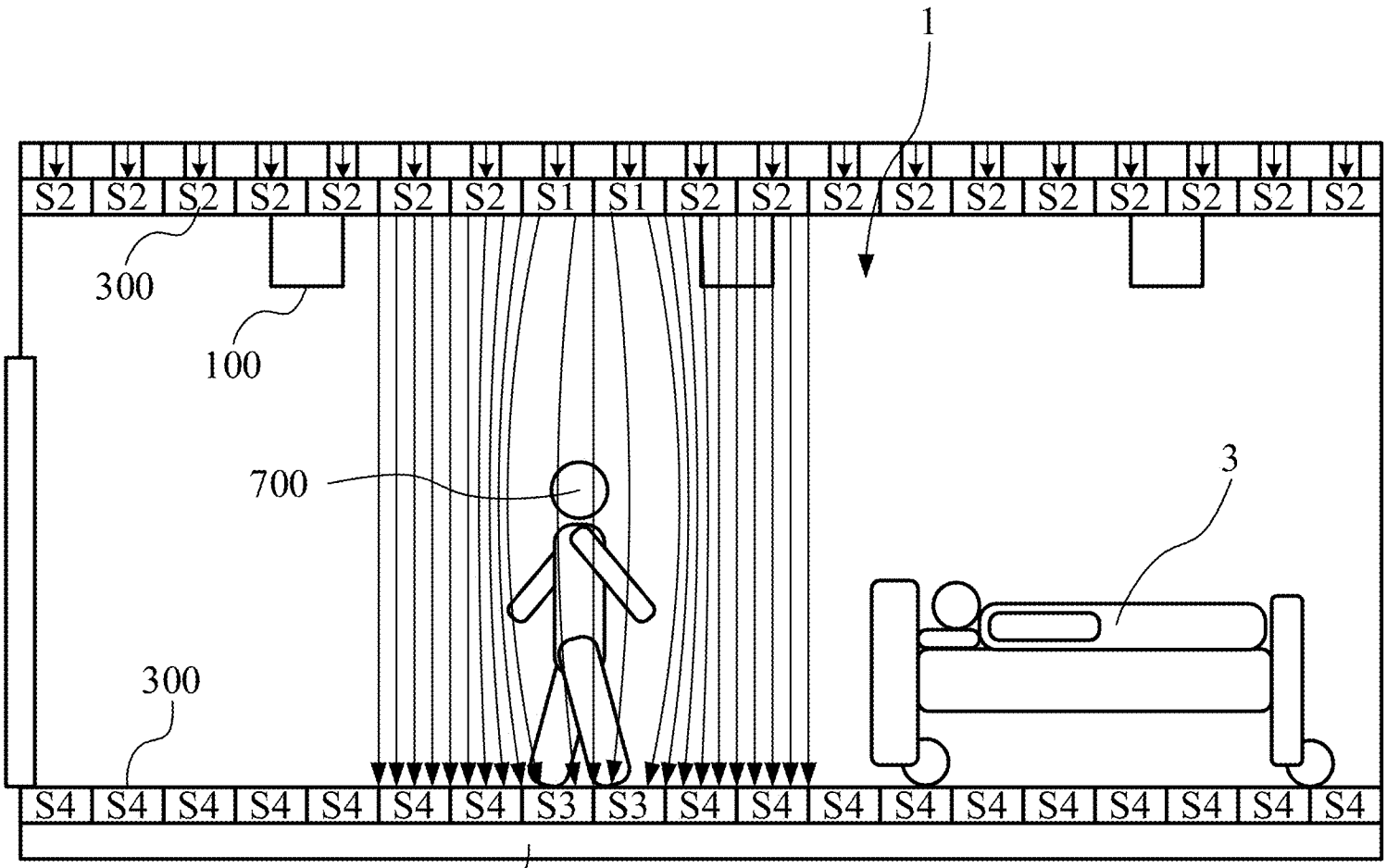
FIG. 1 is a schematic cross-sectional view of a protected space, according to a particular embodiment of the disclosure.

The following embodiments of the disclosure are herein described in detail with reference to the accompanying drawings. These drawings show specific examples of the embodiments of the disclosure. These embodiments are provided so that this disclosure will be thorough and complete, and will fully convey the scope of the invention to those skilled in the art. It is to be acknowledged that these embodiments are exemplary implementations and are not to be construed as limiting the scope of the disclosure in any way. Further modifications to the disclosed embodiments, as well as other embodiments, are also included within the scope of the appended claims.

These embodiments are provided so that this disclosure is thorough and complete, and fully conveys the inventive concept to those skilled in the art. Regarding the drawings, the relative proportions and ratios of elements in the drawings may be exaggerated or diminished in size for the sake of clarity and convenience. Such arbitrary proportions are only illustrative and not limiting in any way. The same reference numbers are used in the drawings and description to refer to the same or like parts. As used herein, the singular forms "a", "an" and "the" are intended to include the plural forms as well, unless the context clearly indicates otherwise.

It is to be acknowledged that, although the terms 'first', 'second', 'third', and so on, may be used herein to describe various elements, these elements should not be limited by these terms. These terms are used only for the purpose of distinguishing one component from another component. Thus, a first element discussed herein could be termed a second element without altering the description of the disclosure. As used herein, the term "or" includes all combinations of one or more of the associated listed items.

It will be acknowledged that when an element or layer is referred to as being "on," "connected to" or "coupled to" another element or layer, it can be directly on, connected or coupled to the other element or layer, or intervening elements or layers may be present. In contrast, when an element is referred to as being "directly on," "directly connected to" or "directly coupled to" another element or layer, there are no intervening elements or layers present.

In addition, unless explicitly described to the contrary, the words "comprise" and "include", and variations such as "comprises", "comprising", "includes", or "including", will be acknowledged to imply the inclusion of stated elements but not the exclusion of any other elements.

The disclosure applies the natural laws of fluid mechanics to detect a position of a person and selects air supply devices and air exhaust devices, which are disposed above and below the person respectively, corresponding to the position of the person, and controls wind speeds of the selected air supply devices and the selected air exhaust devices to be different from wind speeds of other air supply devices and other air exhaust devices not corresponding to the location of the person, so that the air pressure applied on a space where person is located can be different from the air pressure applied on a space where the person is not located, and positive pressure or negative pressure can be produced on the location of the person, thereby realizing the special technical effect of providing an air protection barrier on the person.

Figure 2A:
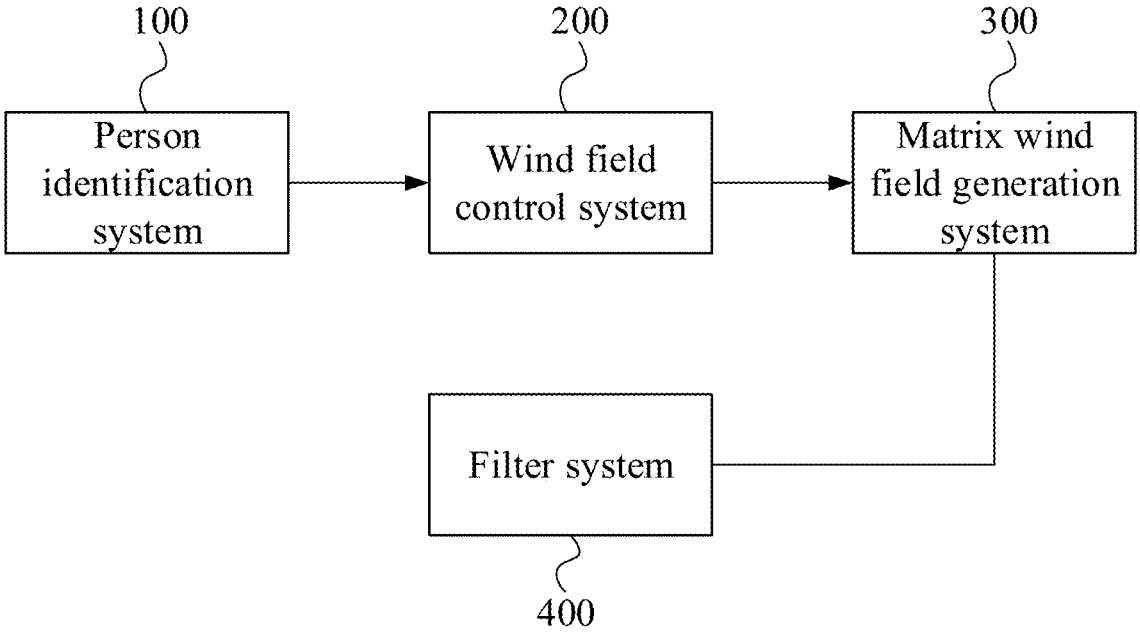
FIG. 2A is a system framework diagram of a wind barrier generation system with protective function, according to the disclosure.

Please refer to FIG. 1, which is a schematic cross-sectional view of a protected space of a particular embodiment of the disclosure. The disclosure applies several systems to produce positive pressure or negative pressure on the person. Please also refer to FIG. 2A, which is a system framework diagram of a wind barrier generation system with protective function, according to the disclosure. As shown in FIG. 1, the disclosure applies a matrix wind field generation system 300 disposed on a top surface and a bottom surface (on a floor 2) of a protected space 1, to control the wind speed in the location range, where a person 700 is located, different from other location.

In order to achieve the objective of making the wind speed in the location of the person 700 different from that in other location, the disclosure adopts two systems including a person identification system 100 and a matrix wind field generation system 300, and also applies a series of technical means to implement the operations of applying the positive pressure on the location of the person 700 (such as a medical worker) and the negative pressure on the location of the patient 3, so as to achieve the special technical effect of air protection barrier. As shown in FIG. 1, when the wind speeds of air supply devices disposed above and the air exhaust devices disposed below the person 700 in the matrix wind field generation system 300 are controlled to be lower than that of the other nearby air supply devices and other nearby air exhaust devices, a pressure difference in fluid mechanics can be produced to make the space where the person 700 is located under the positive pressure, as shown in FIG. 1; in contrast, when the wind speeds of the air supply devices disposed above and the air exhaust devices disposed below the person 700 in the matrix wind field generation system 300 are controlled to be higher than that in other nearby air supply devices and air exhaust devices, a pressure difference in fluid mechanics can be produced to make the space, where the person 700 is located, under the negative pressure. Obviously, the person identification system 100 capable of accurately determining a location of the person 700 plays a very important role.

Figure 2B:
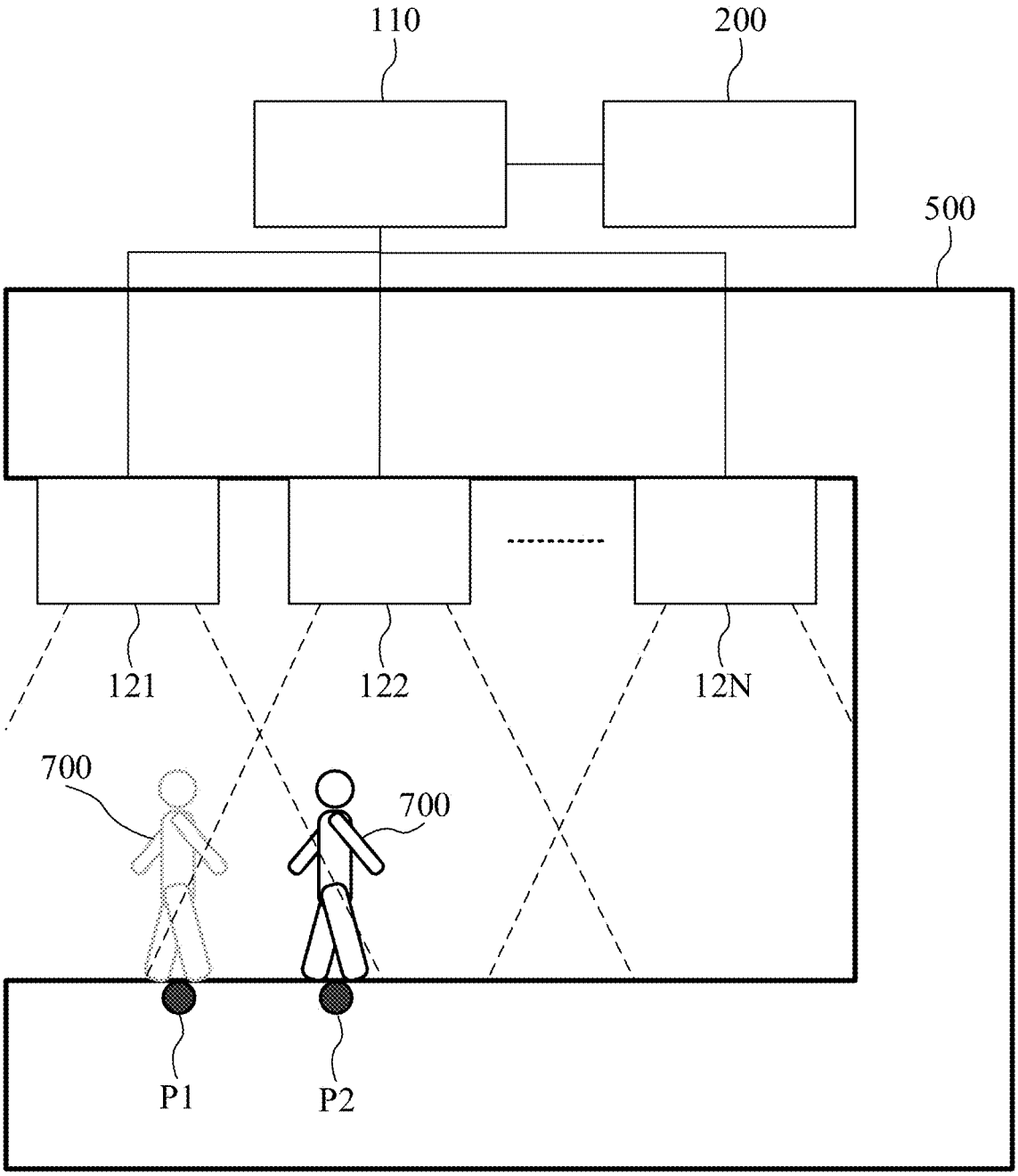
FIG. 2B is a schematic cross-sectional view of a space configuration and detecting operation of a person identification system, according to the disclosure.

The person identification system 100 can be implemented by various technologies, such as an image identifying system, an ultrasonic image identifying system, a lidar image identifying system, an infrared thermal image identifying system, or a pressure pad system; these person identification systems can effectively identify the existence and location of the moving person 700. The person identification system 100 can be disposed according to a size of the protected space 1 and the specification of the person identification system 100. As shown in FIG. 2B, the person identification system 100 can adopt a person identification controller 110, and person identification sensors 121, and 122-12N. In this embodiment, the person identification sensors are disposed on a top surface of the protected space 1 and scan spaces of the person identification sensors are intersected with each other, so that the position and moving status of the person 700 can be accurately sensed.

Please refer back to FIGS. 2A and 2C. The wind barrier generation system mainly includes several systems including a person identification system 100, a wind field control system 200, a matrix wind field generation system 300 and a filter system 400. The person identification system 100 is configured to identify at least one person (the person 700 shown in FIG. 1), and generate a person range coordinate of the at least one person located in the protected space 1. The matrix wind field generation system 300 includes an air supply matrix and an air exhaust matrix. The air supply matrix is disposed on a top surface of the protected space 1 and the air exhaust matrix is disposed on a bottom surface of the protected space 1. The air supply matrix includes air supply devices, and the air exhaust matrix includes air exhaust devices, the air supply devices and the air exhaust devices are arranged facing each other, such as in a one-to-one mode, a many-to-one mode or a one-to-many mode, and each air supply device has an air supply device coordinate, and the air exhaust device has an air exhaust device coordinate. The air supply devices and the air exhaust devices can receive a wind field control command, to generate air-supply wind speeds and air exhaust wind speeds in response to the wind field control command. The filter system 400 is connected to the air supply matrix and the air exhaust matrix via a ventilation duct 500, and configured to filter and disinfect the air flowing through the air supply matrix and the air exhaust matrix. The wind field control system 200, which can be implemented by a programmable logic controller (PLC) or industrial computer server, is connected to the person identification system 100 and the matrix wind field generation system 300, and receives the at least one person range coordinate from the person identification system 100, calculates a wind field control range parameter based on the at least one person range coordinate, maps the wind field control range parameter to the air supply matrix and the air exhaust matrix of the matrix wind field generation system 300, selects at least one of the air supply devices and at least one of the air exhaust devices located within at least one first range circle, and outputs the wind field control command to control the air-supply wind speeds of the air supply devices located within the first range circle to be different from the air-supply wind speeds of the air supply devices not located within the first range circle, and control the air-exhaust wind speeds of the air exhaust devices located within the first range circle to be different from the air-exhaust wind speeds of the air exhaust devices not located within the first range circle.

Figure 2C:
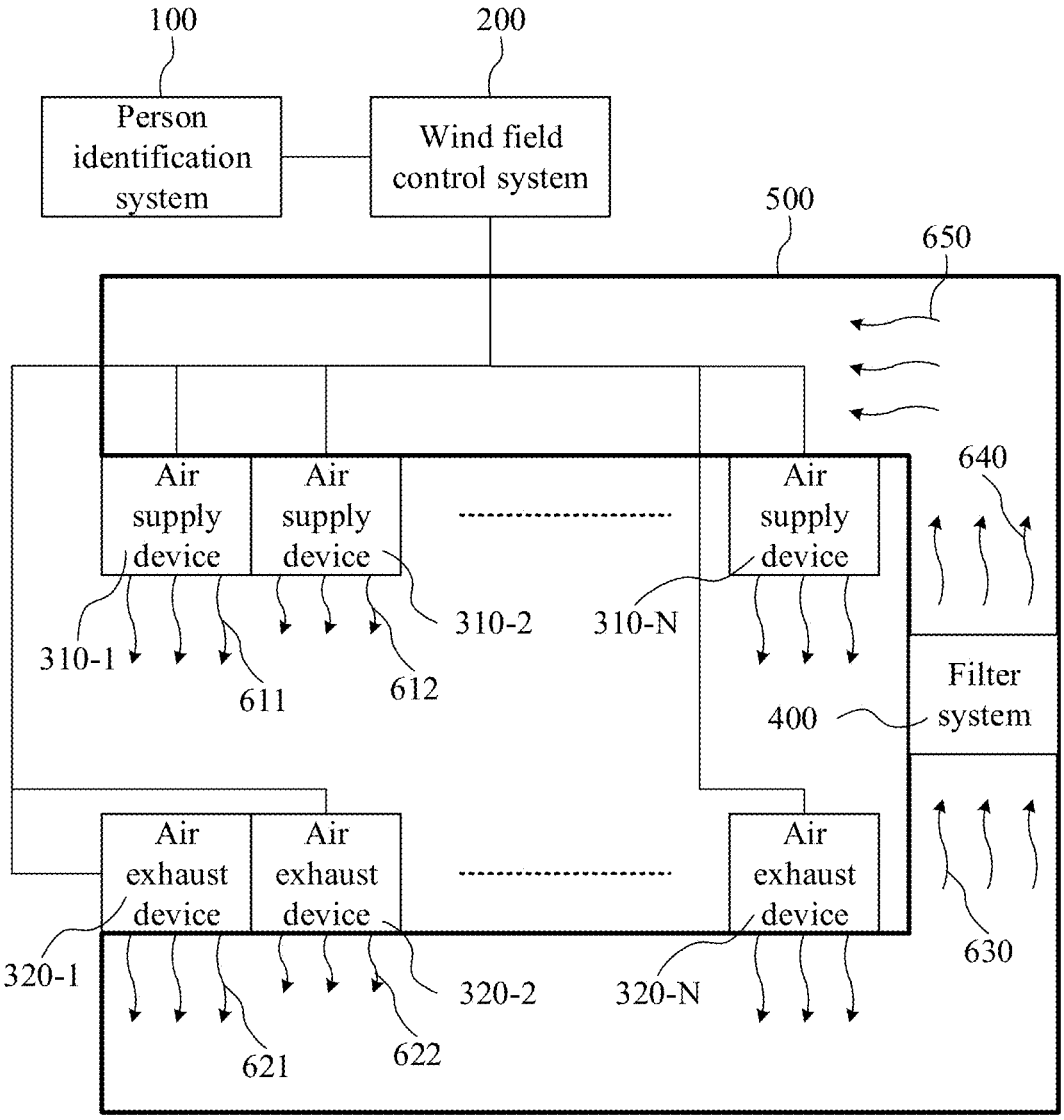
FIG. 2C is a schematic cross-sectional view of a space configuration of a matrix wind field generation system, according to the disclosure.

As shown in FIG. 2C, in the protected space 1, the air supply devices 310-1, and 310-2310-N disposed on the top surface of the protected space 1 and the air exhaust device 320-1, and 320-2320-N disposed on the bottom surface of the protected space 1 are longitudinally corresponding to each other in one-to-one correspondence; the air supply devices 310-1, and 310-2310-N and the air exhaust device 320-1, and 320-2320-N are connected to the ventilation duct 500, and the air flowing cycle (wind direction) includes: winds 611 and 612 produced by the air supply device 310-1, 310-2310-N and blowing downwardly, winds 621 and 622 exhausted by the air exhaust device 320-1, 320-2320-N, and wind 630 before the filter system 400, clean wind 640 after being processed by the filter system 400, and wind 650 into an air inlet of the air supply device 310-1. This cycle is continuously circulated, and the main power for the air circulation is provided by the air supply devices 310-1, 310-2310-N, and the air exhaust devices 320-1, 320-2320-N.

Figure 3A:
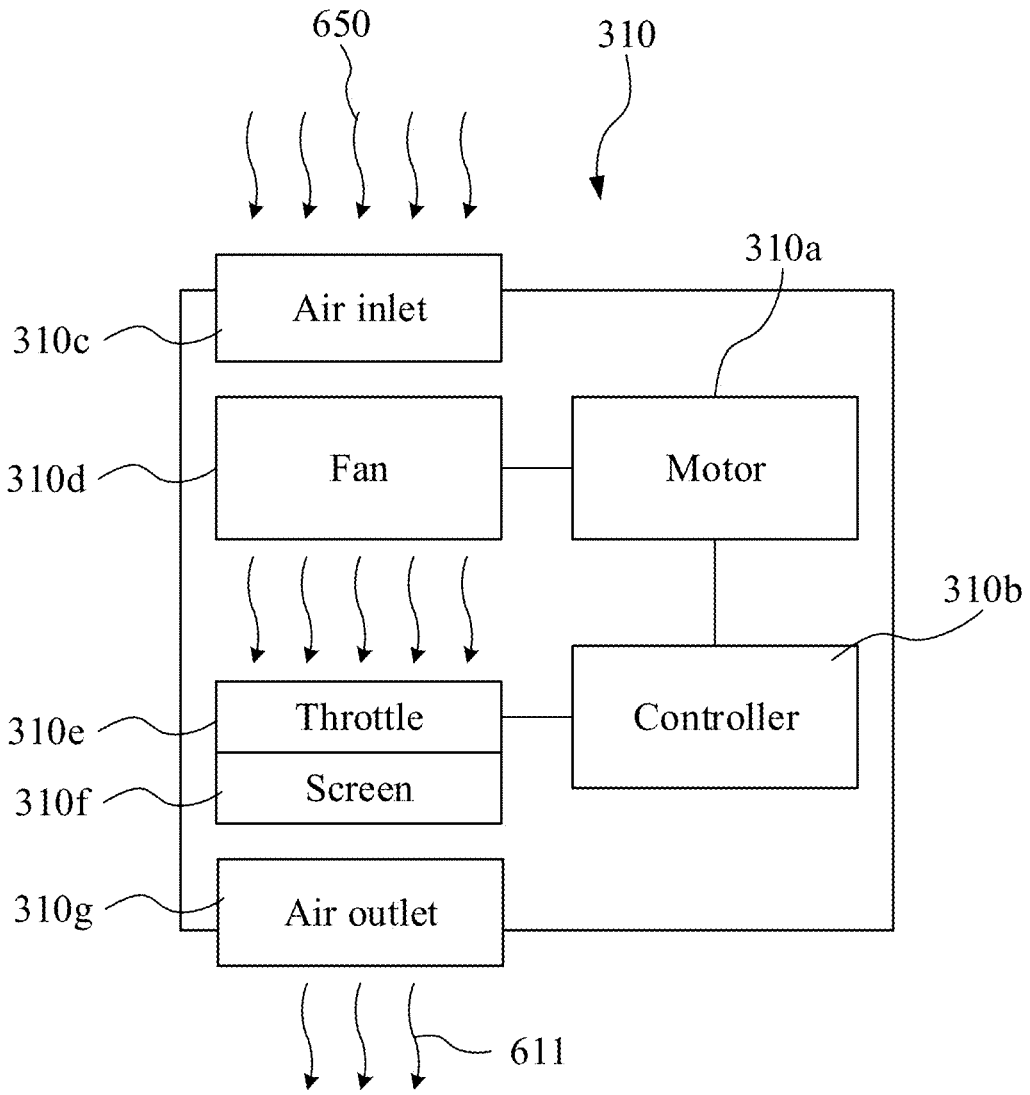
FIGS. 3A and 3B are functional block diagrams of an air supply device 310 and an air exhaust device 320 of the disclosure, respectively.
Figure 3B:
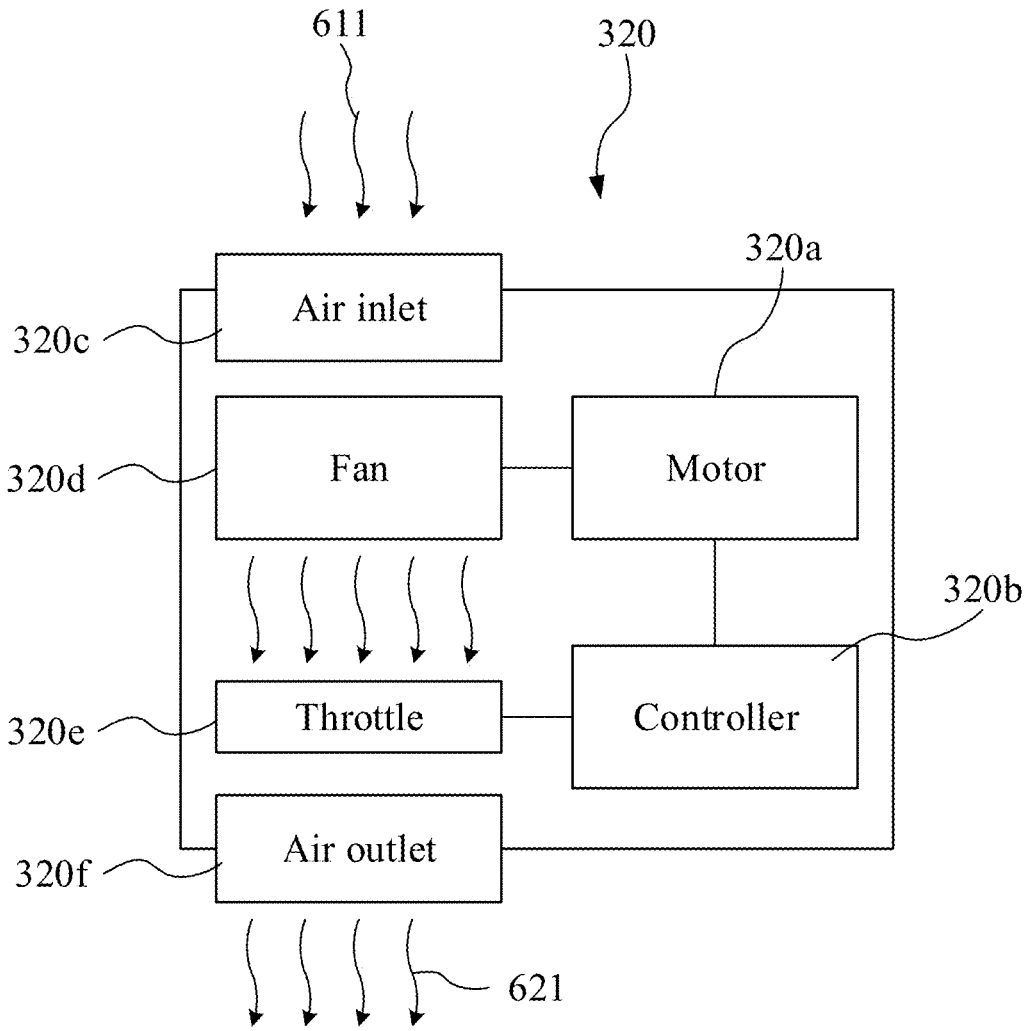

Please refer to FIGS. 3A and 3B, which are functional block diagrams of an air supply device 310 and an air exhaust device 320 of the disclosure, respectively. The air supply device 310 includes an air inlet 310*c* connected to the ventilation duct 500; a fan 310*d* disposed facing the air inlet 310*c*; a motor 310*a* configured to drive the fan 310*d* to rotate to input the air (the wind 650) into the air inlet 310*c*; a throttle 310*e* disposed on a blowing side of the fan 310*d* and configured to control an air supply volume of the fan 310*d*; a screen 310*f* disposed on a blowing side of the throttle 310*e* and configured to uniform an air supply volume of the throttle 310*e*; an air outlet 310*g* disposed on a blowing side of the screen 310*f* and facing the protected space 1; a controller 310*b* connected to the motor 310*a* and the throttle 310*e*. After receiving the wind field control command from the wind field control system 200, the controller 310*b* can adjust a rotation speed of the motor 310*a* and the size of the throttle 310*e* to adjust the air-supply wind speed. The air exhaust device 320 includes: an air inlet 320*c* facing the protected space 1; a fan 320*d* disposed facing the air inlet 320*c*; a throttle 320*e* disposed on a blowing side of the fan 320*d* and configured to control an air exhaust volume of the fan 320*d*; a motor 320*a* configured to drive the fan 320*d* to rotate to input the air (the wind 611) into the air inlet 320*c*; an air outlet 320*f* disposed on a blowing side of the throttle 320*e* and facing the ventilation duct 500 and configured to exhaust the wind 621; a controller 320*b* connected to the motor 320*a* and the throttle 320*e*. After receiving the wind field control command from the wind field control system 200, the controller 320*b* adjusts the rotation speed of the motor 320*a* and the size of the throttle 320*e*, to adjust the air-exhaust wind speed.

According to the illustration for FIG. 2, the wind field control system 200 of the disclosure mainly control the entire system flow. The wind field control system 200 receives the at least one person range coordinate from the person identification system 100, and calculates and generates a first range circle corresponding to the at least one person range coordinate. The air supply devices and the air exhaust devices located within the first range circle are the targets of which wind speeds are to be adjusted by the wind field control system 200. In general, the wind field control system 200 can issue the wind field control command of setting equal wind speed when there is no one in the space; that is, the air-supply wind speeds produced by the air supply devices are the same, and the air-exhaust wind speeds produced by the air exhaust devices are the same. Furthermore, the air-exhaust wind speed can be higher than the air-supply wind speed, to achieve the basic condition for forming the ward with negative pressure.

Obviously, the disclosure can generate the first range circle based on the person range coordinate transmitted from the person identification system 100 because the person identification system 100 and the matrix wind field generation system 300 of the disclosure share the protected space; that is, the person identification system 100 and the matrix wind field generation system 300 have the same projection planes. The wind field control system 200 clearly has the person range coordinate of the person 700 generated by the person identification system 100 and the coordinates of the air supply devices and the air exhaust devices of the matrix wind field generation system 300, so that the wind field control system 200 can map the person range coordinate of the person 700 and the coordinates of the air supply devices and the air exhaust devices with each other.

Compared with the point or line range of the person range coordinate of the person 700, the coordinates of the air supply devices and the air exhaust devices defined as the first range circle are discontinuous. In practice, it is hard to directly map the person range coordinate of the person 700 to the coordinates of the air supply devices and the air exhaust devices indicating the first range circle, so the operation of setting the first range circle mush be redefined.

Figure 4A:
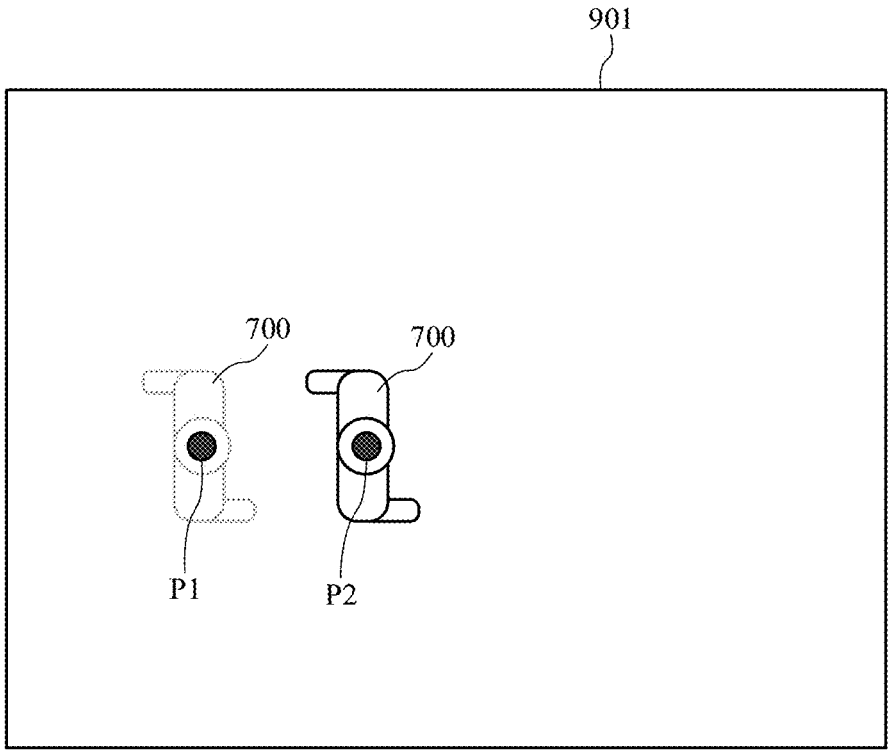
FIG. 4A is a schematic top view of a projection space 901 of a protected space 1, according to the disclosure.
Figure 4B:
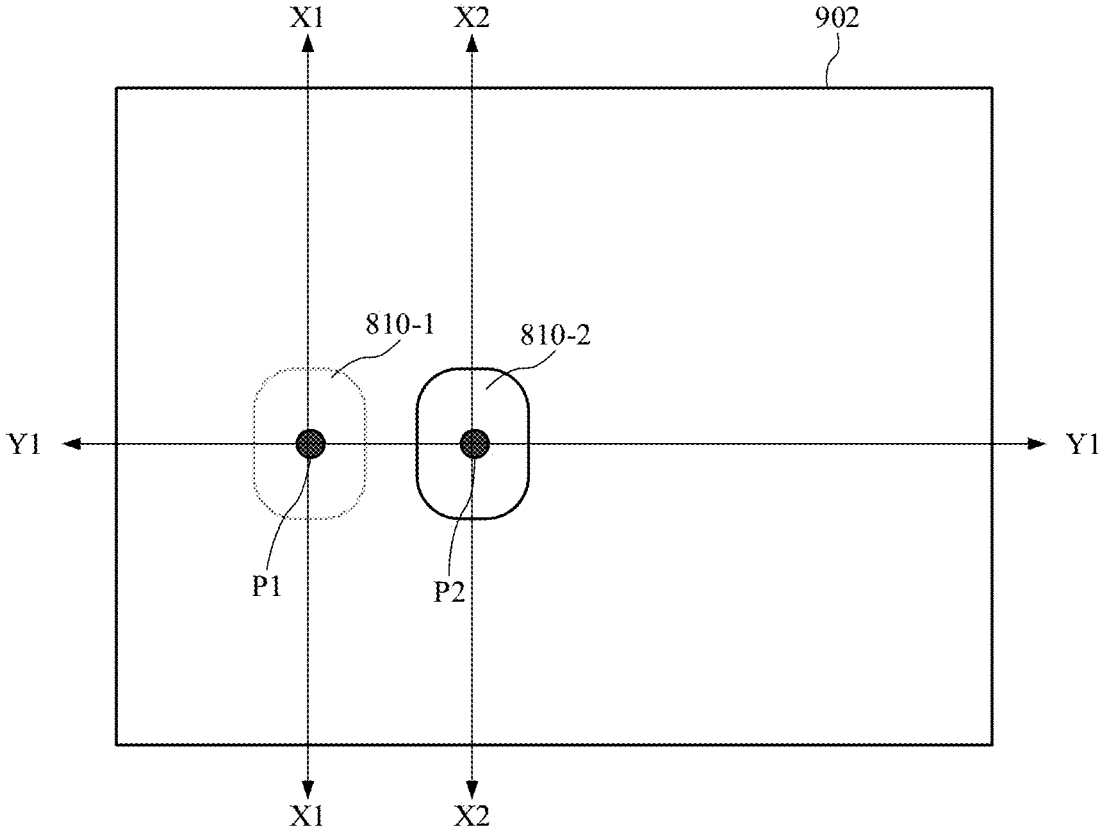
FIG. 4B is a schematic view of image data captured by a person identification system, according to the disclosure.

Please refer to FIGS. 4A to 4E, which show a particular embodiment of an operation of using the person range coordinate of the person 700 to set the first range circle. FIG. 4A is a top view of the projection space 901 of the protected space 1. As shown in FIG. 4A, the person 700 moves to a point P2 from a point P1. FIG. 4B shows the image data captured by the person identification system 100 (such as an image identifying system, an infrared image identifying system, or an ultrasonic image identifying system); in the projection space 902 identified by the person identification system 100 of the protected space 1, the person 700 is shown as an object range 810-1 and an object range 810-2. the person identification system 100 transmits the person range coordinates, which express the object range 810-1 and the object range 810-2 respectively, to the wind field control system 200. The wind field control system 200 calculates a center coordinate of the point P1 based on range coordinates of the object range 810-1 and a center coordinate of the point P2 based on the range coordinate of the object range 810-2. Please refer to FIG. 4C, which shows a top view of a projection space 903 of the air supply devices in the protected space 1. After transforming the projection space 902 to the projection space 903 of the air supply device, the wind field control system 200 can overlap the person range coordinates of the object range 810-1 and the object range 810-2 with the projection space 903 of the air supply devices. The center coordinates of the point P1 and the point P2 are (X1, Y1) and (X2, Y1). Next, the wind field control system 200 can define the first range circles based on the range coordinates of the object range 810-1 and the object range 810-2.

Figure 4C:
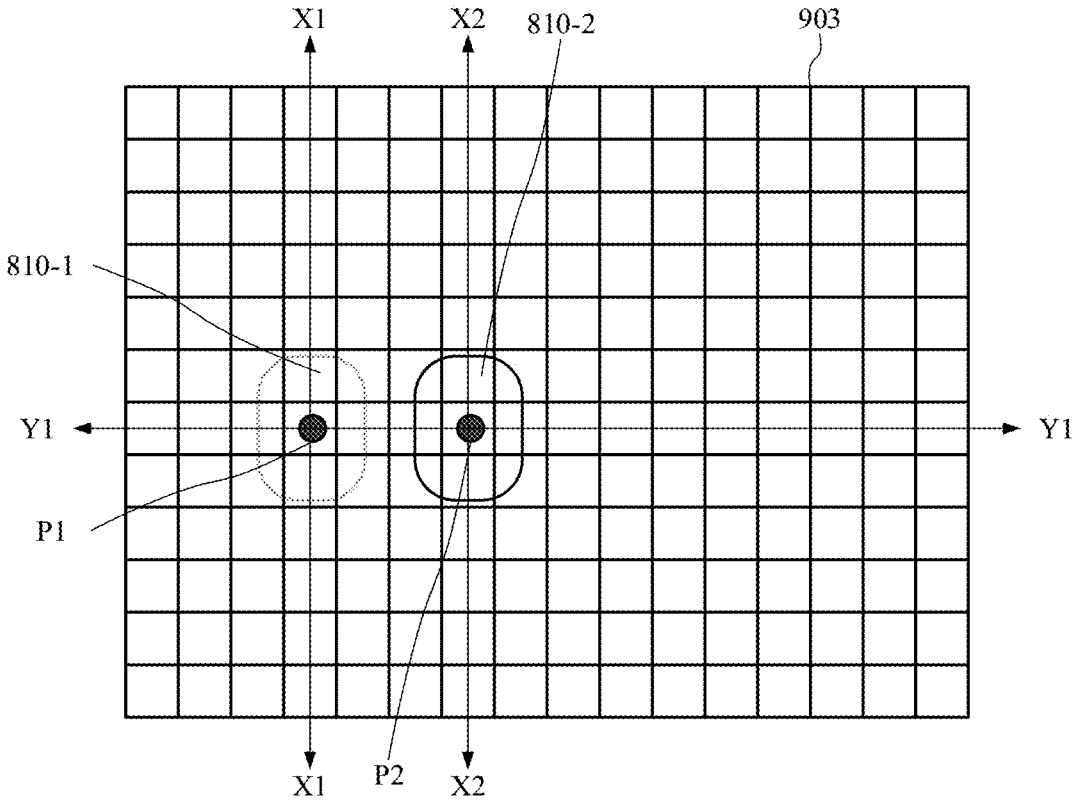
FIG. 4C is a schematic top view of a projection space of an air supply device located on a top surface of a protected space 1, according to the disclosure.
Figure 4D:
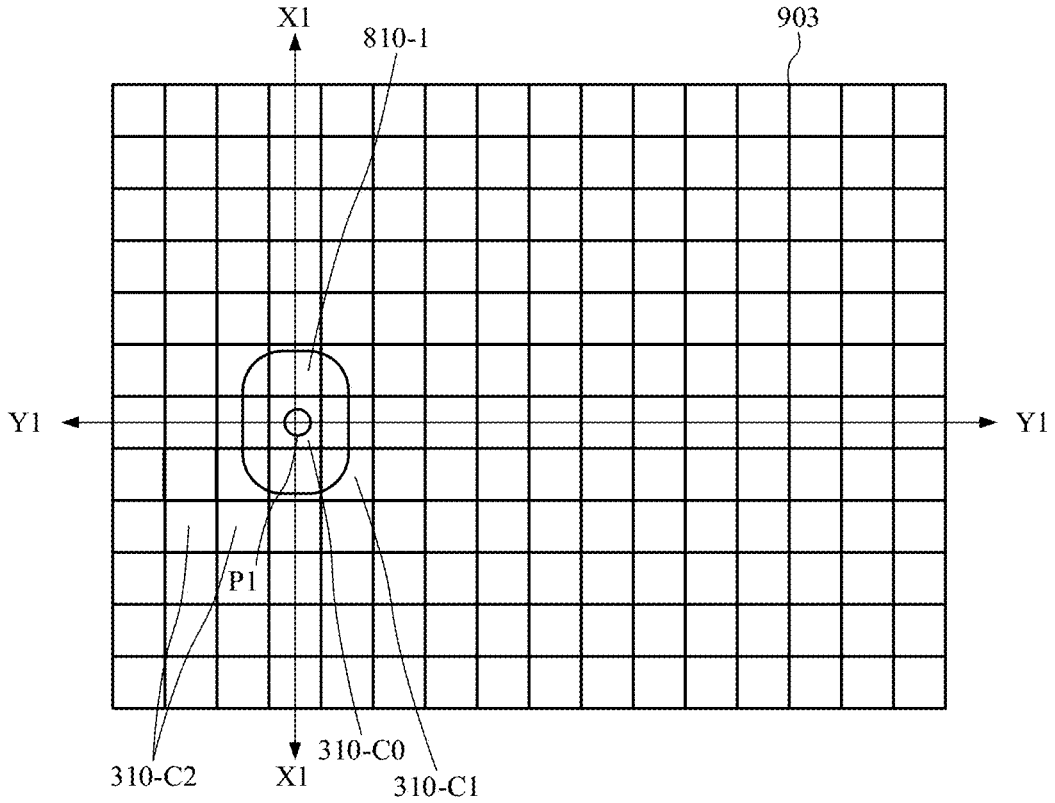
FIGS. 4D and 4E are schematic views of a projection space of a first range circle defined based on a center coordinate, according to the disclosure.

The first range circle of the disclosure can be defined by various particular embodiments, such as a center coordinate defining method, or a person range coordinate defining method. The center coordinate defining method will be described in the following paragraphs first. Please refer to FIGS. 4D and 4E. In FIG. 4D, the wind field control system 200 assigns an air-supply device as the central air-supply device based on the calculated center coordinate (X1, Y1) of the point P1, and also assigns an air-exhaust device as the central air-exhaust device; that is, the central air-supply device and the central air-exhaust device cover the coordinate of the point P1. In this embodiment, there are one air supply device and one air exhaust device covering the center coordinate (X1, Y1) of point P1; however, in other embodiment, the center coordinate of the point P1 may just be located between two air supply devices, or between four air supply devices, so the center coordinate of the point P1 may correspond to at least one central air-supply device and at least one central air-exhaust device. The amount of the central air-supply device(s) and the central exhaust device(s) are also changed by the structures the air supply matrix and the air exhaust matrix; for example, FIG. 4C shows a square matrix of air supply devices arranged in a tight structure, and the maximum amount of the central air-supply devices associated with the point P1 is four; FIG. 4K shows a matrix of air supply devices 340 staggered in square arrangement, and the maximum amount of the central air-supply devices associated with the point P1 is three; FIG. 4L shows a matrix of air supply devices 330 arranged in a hexagonal honeycomb structure, and the maximum amount of the central air-supply devices associated with the point P1 is three.

Please refer back to FIG. 4D. The center coordinate (X1, Y1) corresponds to an air supply device, the wind field control system 200 defines the corresponding air supply device as a central air-supply device 310-C0, and defines the nine air supply devices enclosing the central air-supply device 310-C0 as the air supply device 310-C1 of the first range circle, and define 14 air supply devices enclosing the air supply device 310-C1 of the first range circle as the air supply device 310-C2 of a second range circle, and so forth; for the air exhaust devices, the defining process is the same as the above-mentioned process, so the detailed descriptions are not repeated herein.

Figure 4E:
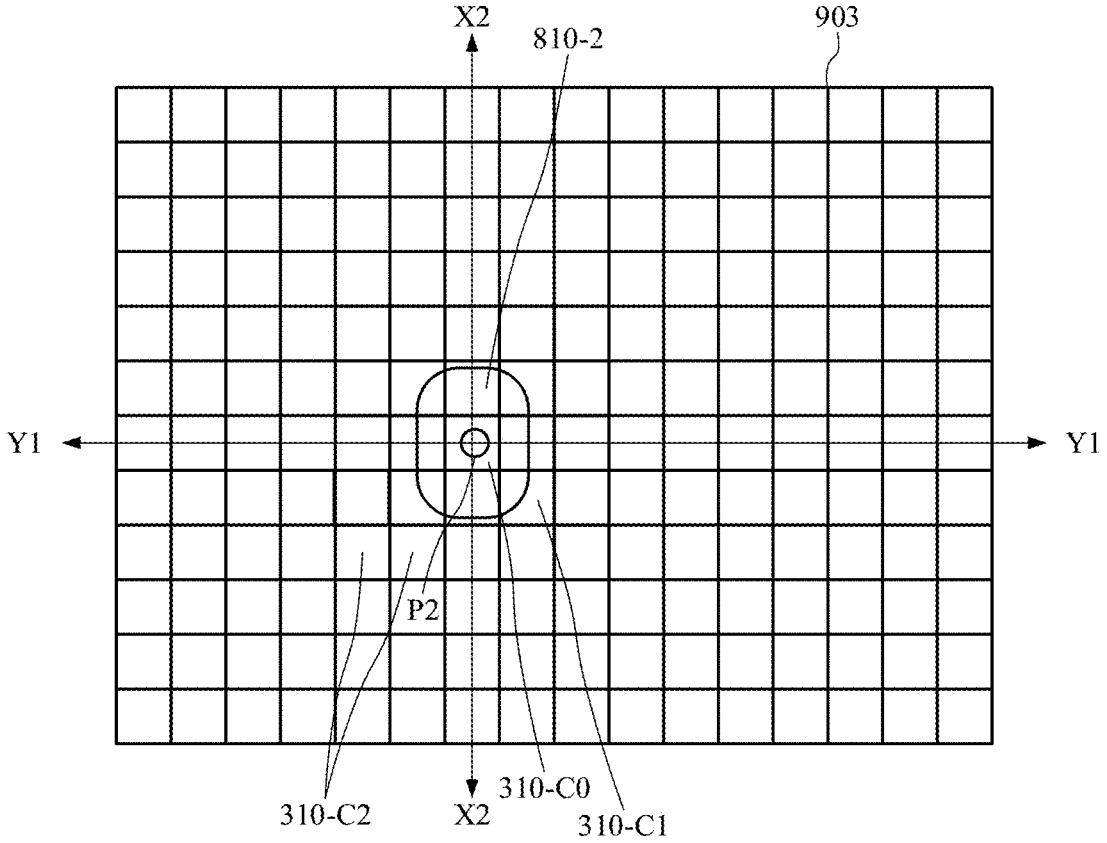
Figure 4F:
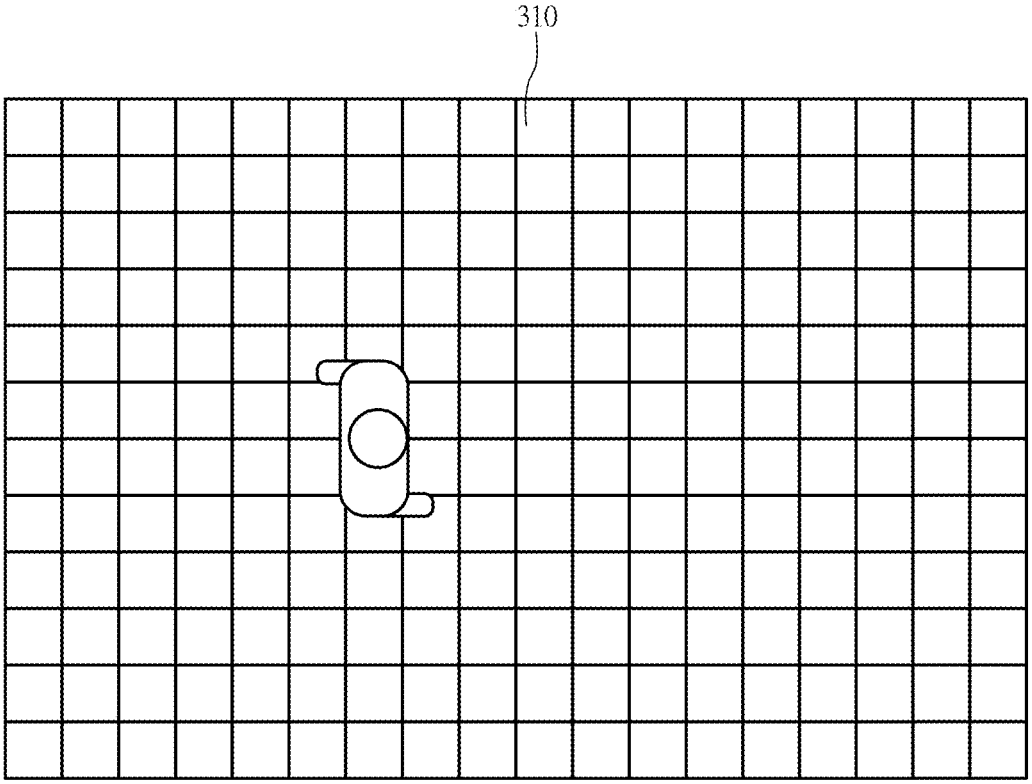
FIGS. 4F to 4L are schematic views of different embodiments of an air supply matrix of the disclosure.
Figure 4G:
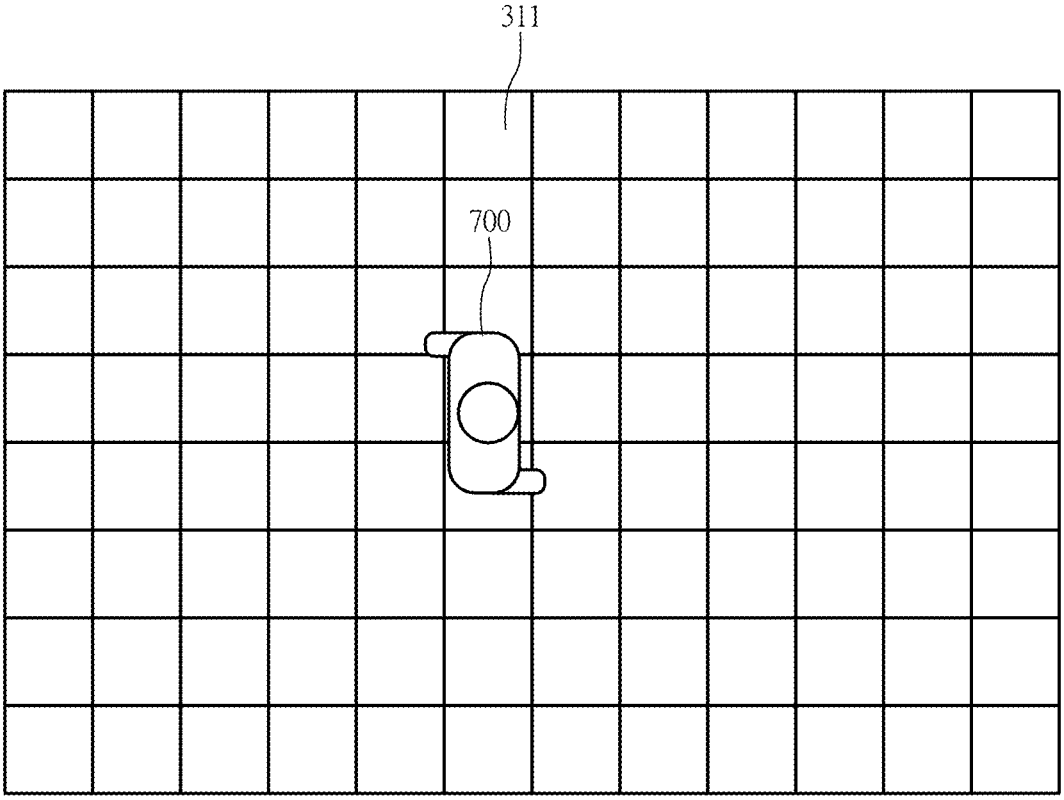

In FIG. 4E, when the person 700 moves to the point P2, the center coordinate (X2, Y1) also corresponds to an air supply device, the wind field control system 200 defines the corresponding air supply device as the central air-supply device 310-C0, and defines nine air supply devices enclosing the central air-supply device 310-C0 as the air supply devices 310-C1 of the first range circle, and defines fourteen air supply devices enclosing the air supply devices 310-C1 of the first range circle as the air supply devices 310-C2 of the second range circle, and so forth; for the air exhaust devices, the defining process is the same as the above-mentioned process, so the detailed descriptions are not repeated herein.

After at least one central air-supply device is defined as the central range circle and the first range circle is also defined, the wind speeds of the central air-supply device and the air supply devices of first range circle can be controlled to be different from the wind speed of other air supply devices; for example, the wind speeds of the central air-supply device and the air supply devices of the first range circle can be lower than the wind speeds of the other air supply devices, so as to produce positive pressure on the space of the first range circle, and the opposite operations can produce negative pressure. Alternatively, the wind speed of the central air-supply device can be minimum, the wind speeds of the air supply devices of the first range circle are second minimum, and the wind speeds of other the air supply devices are maximum; or the above control can be operated opposite. The above-mentioned control operations are executed by a control program of the wind field control system 200. The above-mentioned control operations are the control manner of the embodiments of FIGS. 4D and 4E.

Figure 5A:
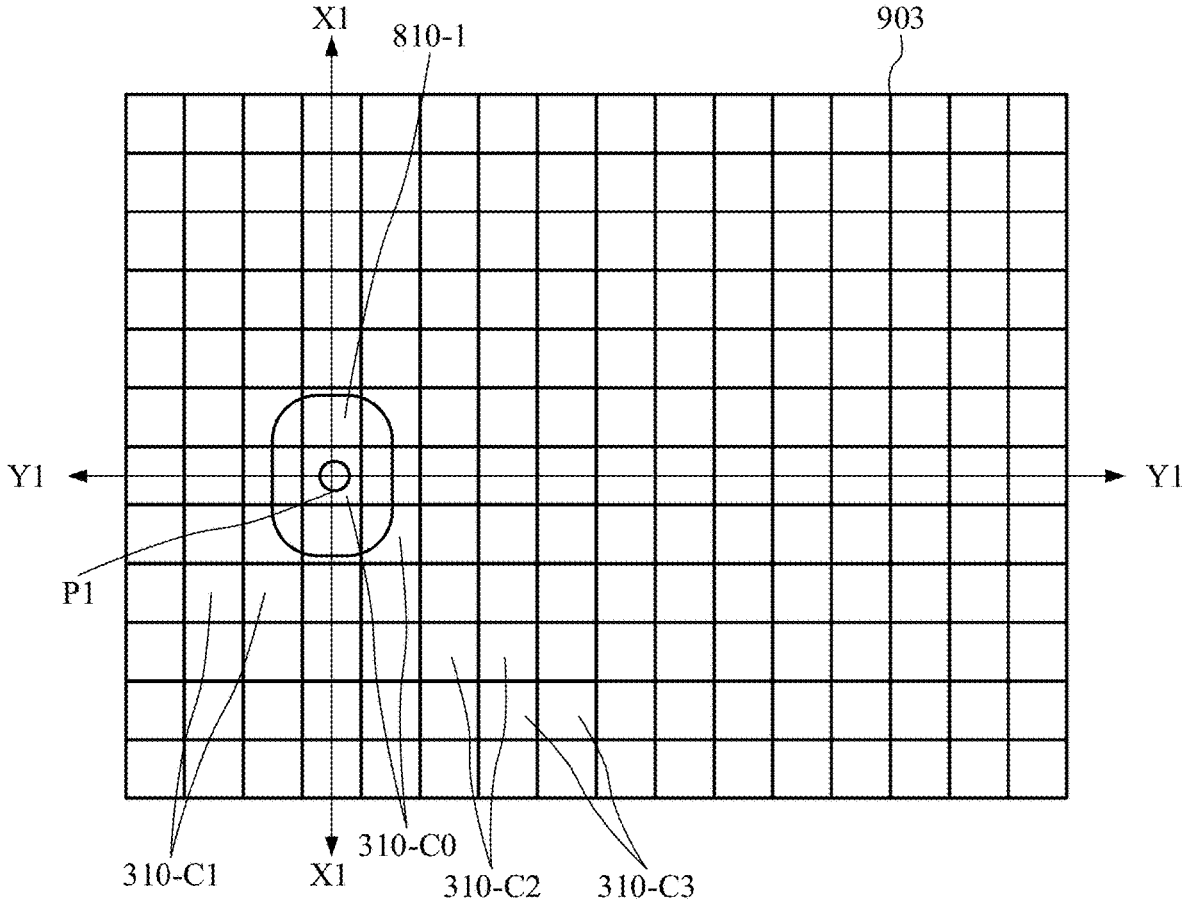
FIGS. 5A and 5B are schematic views of a projection space of a first range circle defined by a center coordinate, according to another embodiment of the disclosure.
Figure 5B:
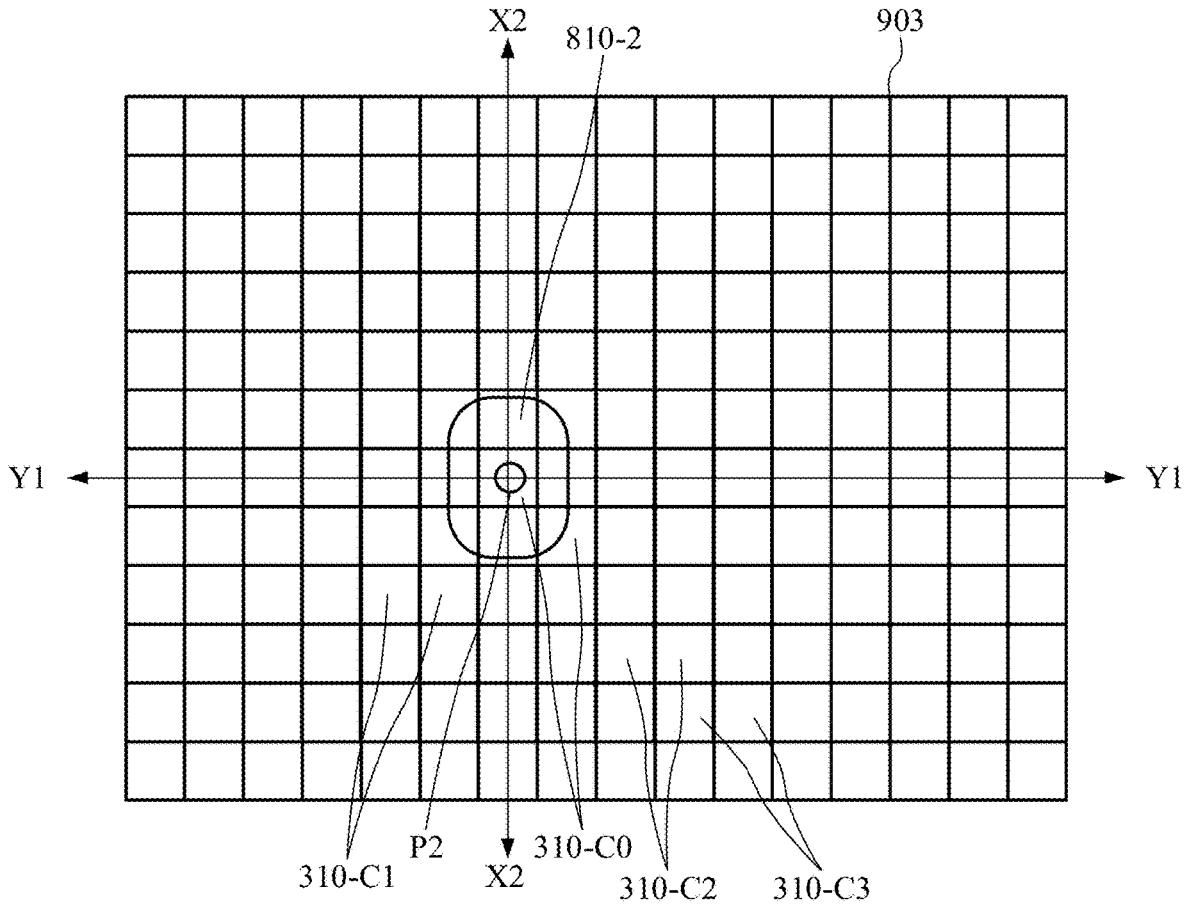

Besides the embodiment of controlling the wind speeds of the central air-supply device and the air supply devices of the central range circle (the embodiment of FIGS. 4D and 4E), another embodiment is to control the wind speeds of the air supply devices other than the central air-supply device and the air supply devices of the central range circle to be lower than or higher than the wind speeds of the central air-supply device and the air supply devices of the central range circle. Please refer to FIGS. 5A and 5B. In this embodiment, the central range circle is defined as the air supply devices 310-C0 included in the range coordinate of the object range 810-1; as shown in FIGS. 5A and 5B, the central range circle includes nine air supply devices. The air supply devices enclosing the central range circle are the air supply device 310-C1 of the first range circle, and the amount of the air supply device 310-C1 is 24 as shown in FIGS. 5A and 5B; the air supply devices 310-C2 enclosing the first range circle are defined as a second range circle; the air supply devices 310-C3 enclosing the second range circle are defined as a third range circle, and so forth. The wind speeds of the air supply devices of the first range circle, the second range circle and the third range circle can be controlled to be different from that of the air supply devices of the central range circle. For example, when the wind speeds of the air supply devices of the central range circle are minimum, the positive pressure is formed in the protected space; in contrast, the negative pressure is formed in the protected space.

The disclosure can define the first range circle and the central range circle based on the range coordinate of the detected person no matter which manner is used, and then control the wind speeds within the central range circle or the first range circle to be different from the wind speed of other part, so as to achieve the special technical effect of applying positive pressure or negative pressure on the local space. In concept, no matter the range coordinate of the detected person is enclosed by the central range circle or the first range circle, the disclosure produces the positive pressure or negative pressure on the space where the person is located, based on the air supply devices enclosing the range coordinate of the detected person.

In the embodiments of FIGS. 4D and 4E, the size of the first range circle can just enclose the object range 810-1 and the object range 810-2, the size of the embodiment of the air supply device is 20 cm×20 cm, the width of three air supply devices is 60 cm, and a shoulder width of a general person is in a range of 40 cm to 50 cm. When the size of the air supply device is larger or smaller, the amount of the projection planes of the air supply devices corresponding to the object range 810-1 and the object range 810-2 can be different. For example, in FIG. 4F, the size of the air supply device 310 is 20 cm×20 cm, and the person 700 can be covered by 6~12 air supply devices; in FIG. 4G, the size of the air supply device 311 is 30 cm×30 cm, and the person 700 can be covered by 4~9 air supply devices; in FIG. 4H, the size of the air supply device 312 is 40 cm×40 cm, and the person 700 can be covered by 2~6 air supply devices; in FIG. 4I, the size of the air supply device 313 is 60 cm×60 cm, and the person 700 can be covered by 1~4 air supply device(s).

Figure 4H:
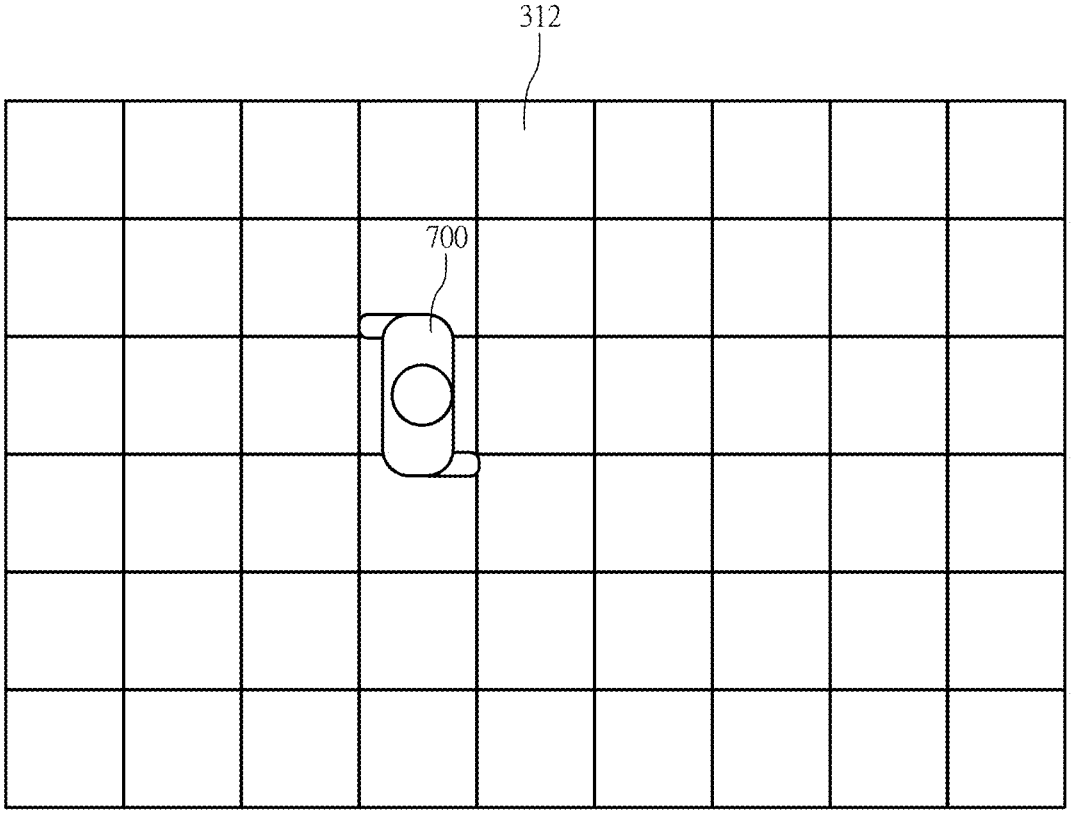
Figure 4I:
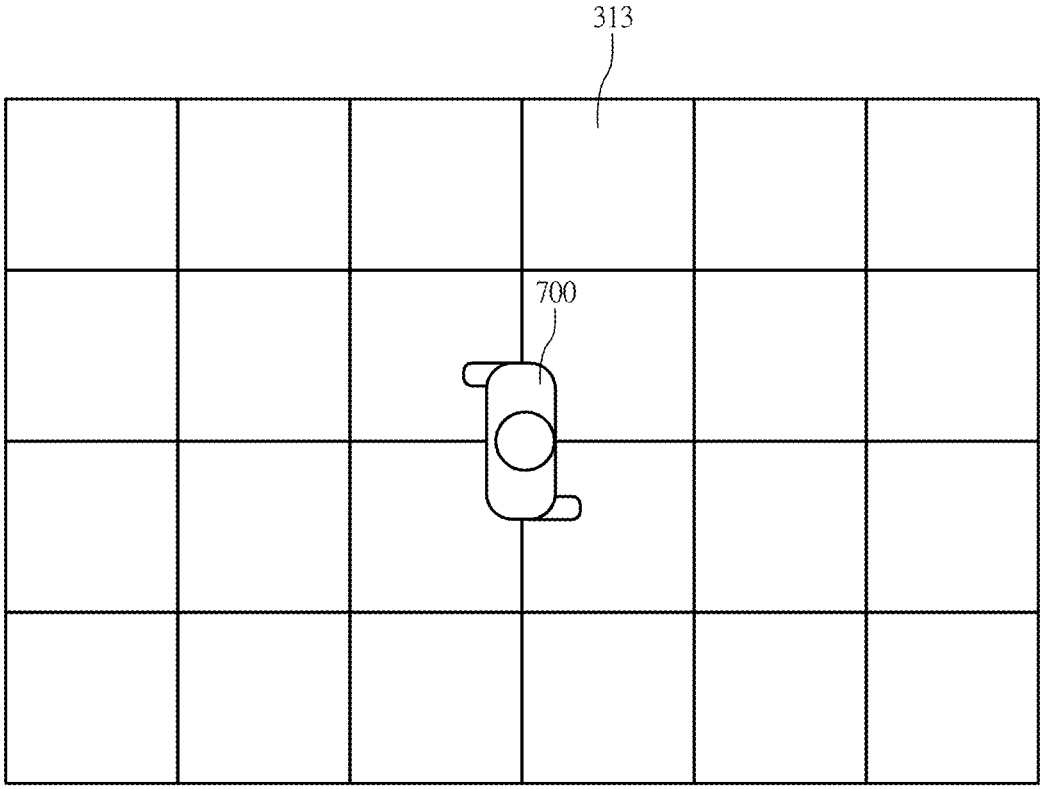
Figure 4J:
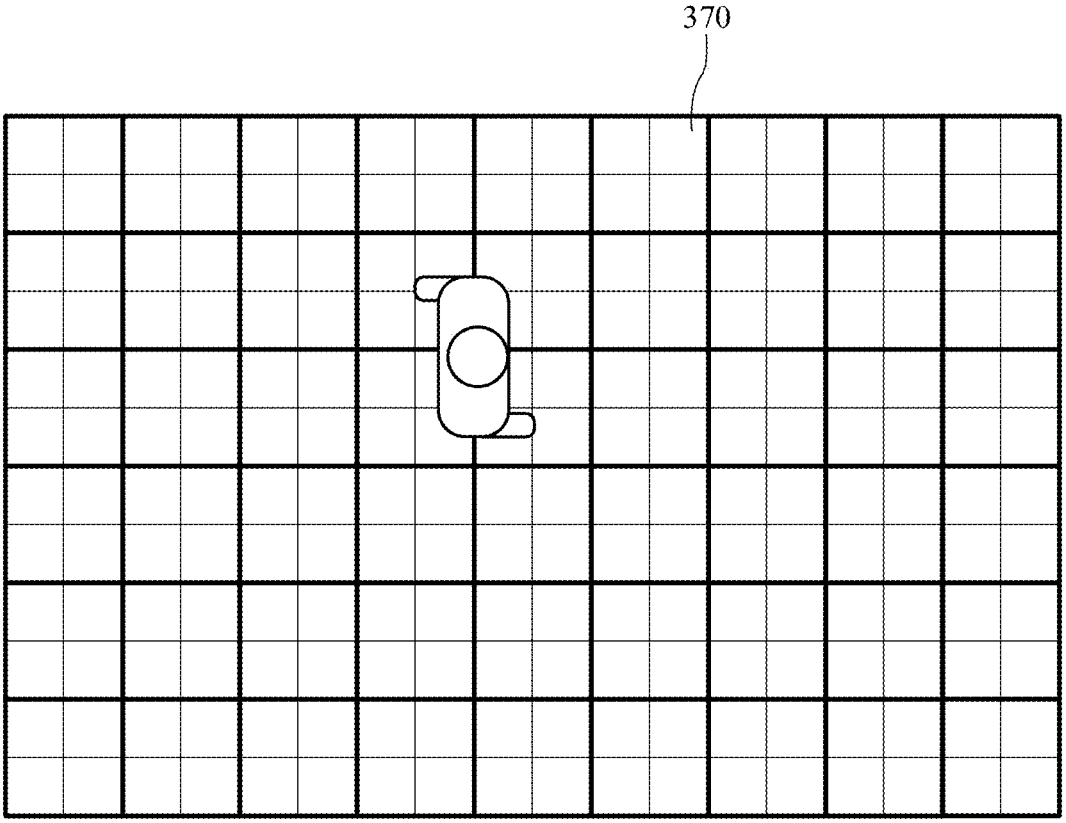
Figure 4K:
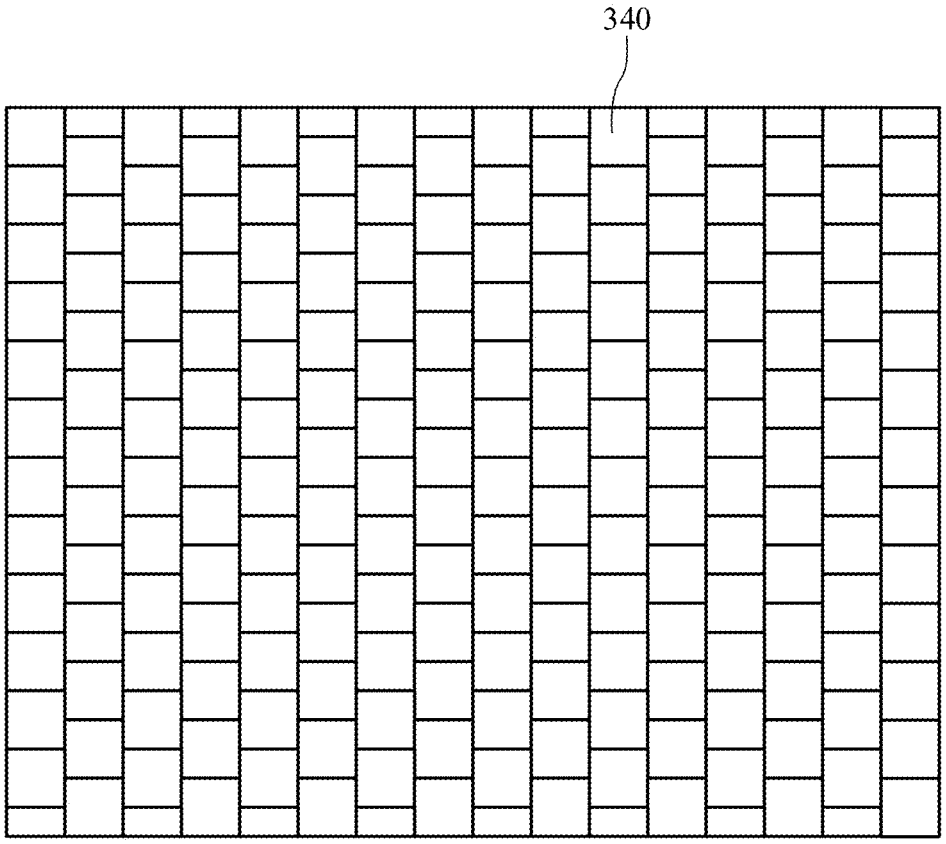
Figure 4L:
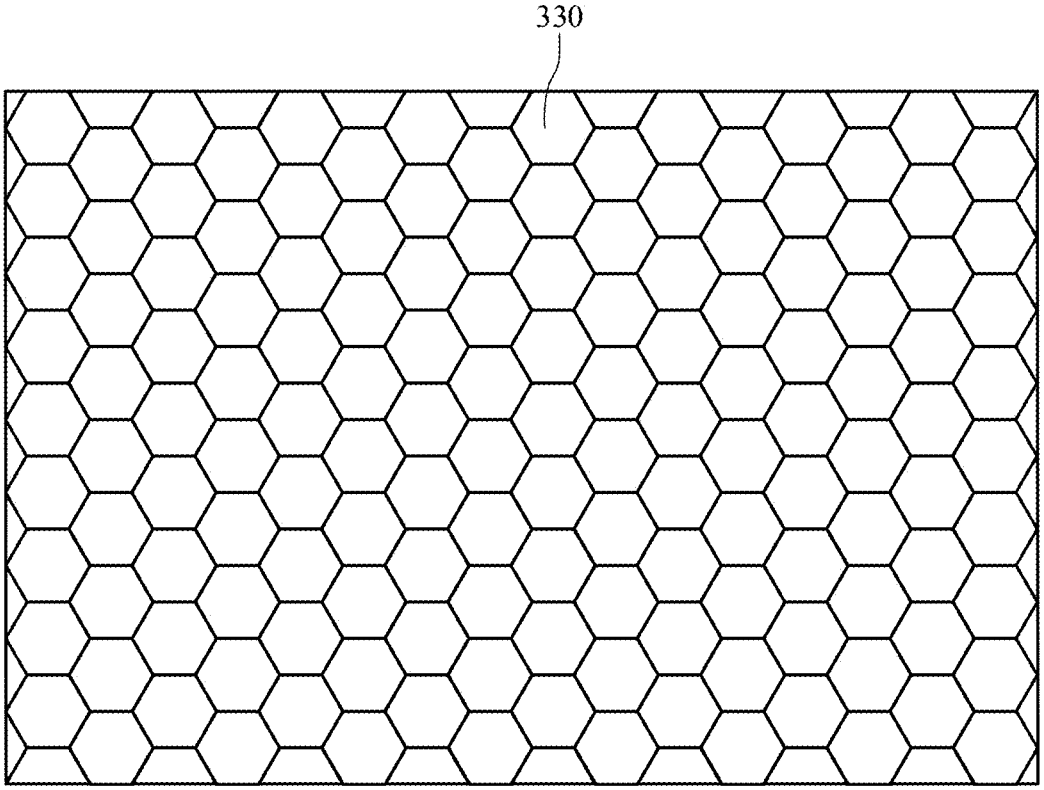

The manner of using the center coordinate to define the first range circle has more applicability in a condition that the air supply device has a smaller size. When the size of the air supply device is larger, the first range circle may be excessive large, for example, in the embodiment of FIG. 4H, the first range circle may include 12 air supply devices, and the range reaches 240 cm×240 cm, so it does not meet the practical requirement. Therefore, as shown in FIG. 4J, the disclosure can adopt another manner in which 4 air outlets are disposed in an air supply device 370 with a size of 40 cm×40 cm, so that the air supply device 370 provide the air outlet with a practical size of 20 cm×20 cm.

The above-mentioned embodiment of the air supply device is implemented by technology of the full covered wind outlet device, that is, the air outlet (or air outlet) of the air supply device blows wind in full area. In other words, the air supply device blows wind through the square area of M cm×M cm at one time, and the wind speeds through parts of the entire area are the same.

Figure 6A:
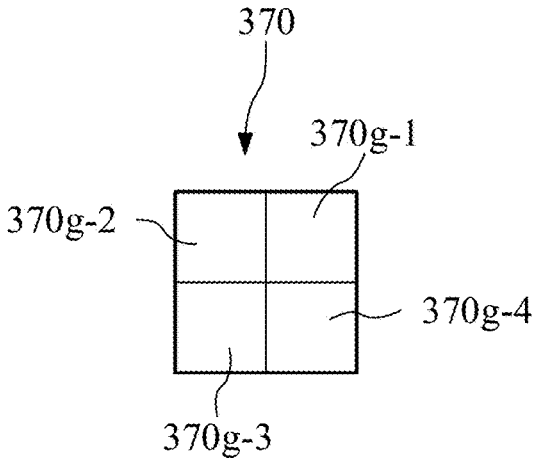
FIGS. 6A and 6B, are a blowing side and a functional block diagram of a four-in-one full covered wind outlet device of the disclosure, respectively.
Figure 6B:
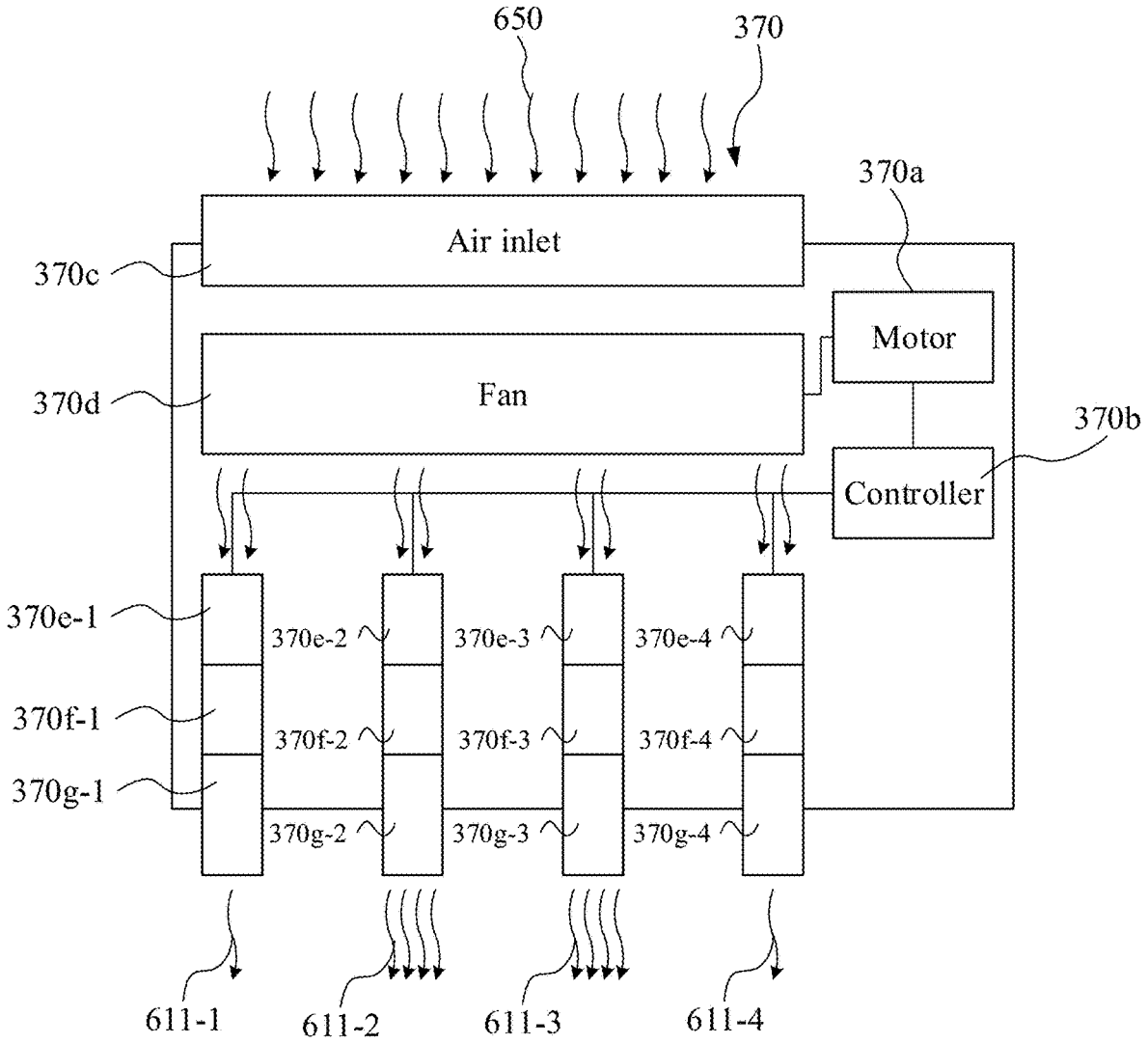

Please refer to FIGS. 6A and 6B, which show a four-in-one full covered wind outlet device. The air supply device 370 includes: an air inlet 370*c* connected to a ventilation duct 500; a fan 370*d* disposed facing the air inlet 370*c*; a motor 370*a* configured to drive the fan 370*d* to rotate to input air (the wind 650) into the air inlet 370*c*; throttles 370*e*-1, 370*e*-2, 370*e*-3 and 370*e*-4 disposed on a blowing side of the fan 370*d* and configured to control an air supply volume of the fan 370*d*; screens 370*f*-1, 370*f*-2, 370*f*-3 and 370*f*-4 disposed on blowing sides of the throttles 370*e*-1, 370*e*-2, 370*e*-3 and 370*e*-4 and configured to uniform the air supply volume of the throttles 370*e*-1, 370*e*-2, 370*e*-3 and 370*e*-4; air outlets 370*g*-1, 370*g*-2, 370*g*-3 and 370*g*-4 disposed on blowing sides of the screens 370*f*-1, 370*e*-2, 370*e*-3, and 370*e*-4 and facing the protected space 1; a controller 370*b* connected to the motor 370*a* and the throttles 370*e*-1, 370*e*-2, 370*e*-3 and 370*e*-4. After receiving a wind field control command from the wind field control system 200, the controller 370*b* adjusts a rotation speed of the motor 370*a* and sizes of the throttles 370*e*-1, 370*e*-2, 370*e*-3 and 370*e*-4, so as to adjust the air-supply wind speeds. The four-in-one full-covered air exhaust device can have a structure the same as that of the four-in-one full covered wind outlet device, and use multiple air inlets and multiple throttles. Each of the throttle 370*e*-1, the throttle 370*e*-2, the throttle 370*e*-3 and the throttle 370*e*-4 can be a fully-open/fully-closed type or adjustable open-degree type. After the controller 370*b* receives the wind field control command transmitted from the wind field control system 200, the controller 370*b* controls the motor 370*a*, the throttles 370*e*-1, 370*e*-2, 370*e*-3 and 370*e*-4 to make the wind 611-1 of the air outlet 370*g*-1, the wind 611-2 of the air outlet 370*g*-2, the wind 611-3 of the air outlet 370*g*-3 and the wind 611-4 of the air outlet 370*g*-4 different from each other.

Figure 7A:
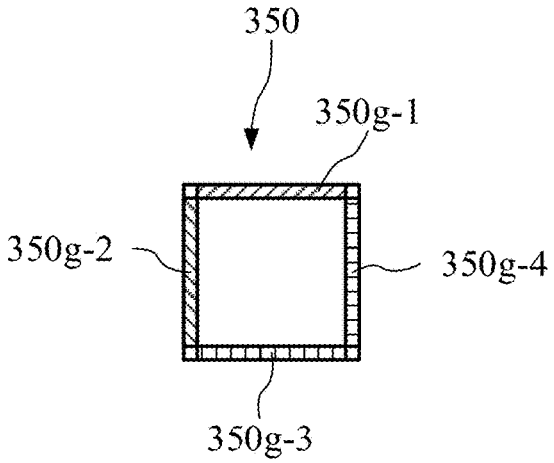
FIGS. 7A and 7B, are a blowing side and a functional block diagram of a peripheral wind outlets device of the disclosure, respectively.

Another particular embodiment of the air supply device of the disclosure will be illustrated in the following paragraphs, and this particular embodiment uses peripheral wind outlets device and peripheral air exhaust devices. Please refer to FIGS. 7A to 7E, which show a shape and a functional block diagram of a square peripheral wind outlets device 350, and the embodiment of the method of defining a first range circle. The peripheral wind outlets device 350 includes four air outlets 350*g*-1, 350*g*-2, 350*g*-3 and 350*g*-4 disposed facing four sides of the protected space 1, respectively, as shown in FIG. 7A.

Figure 7B:
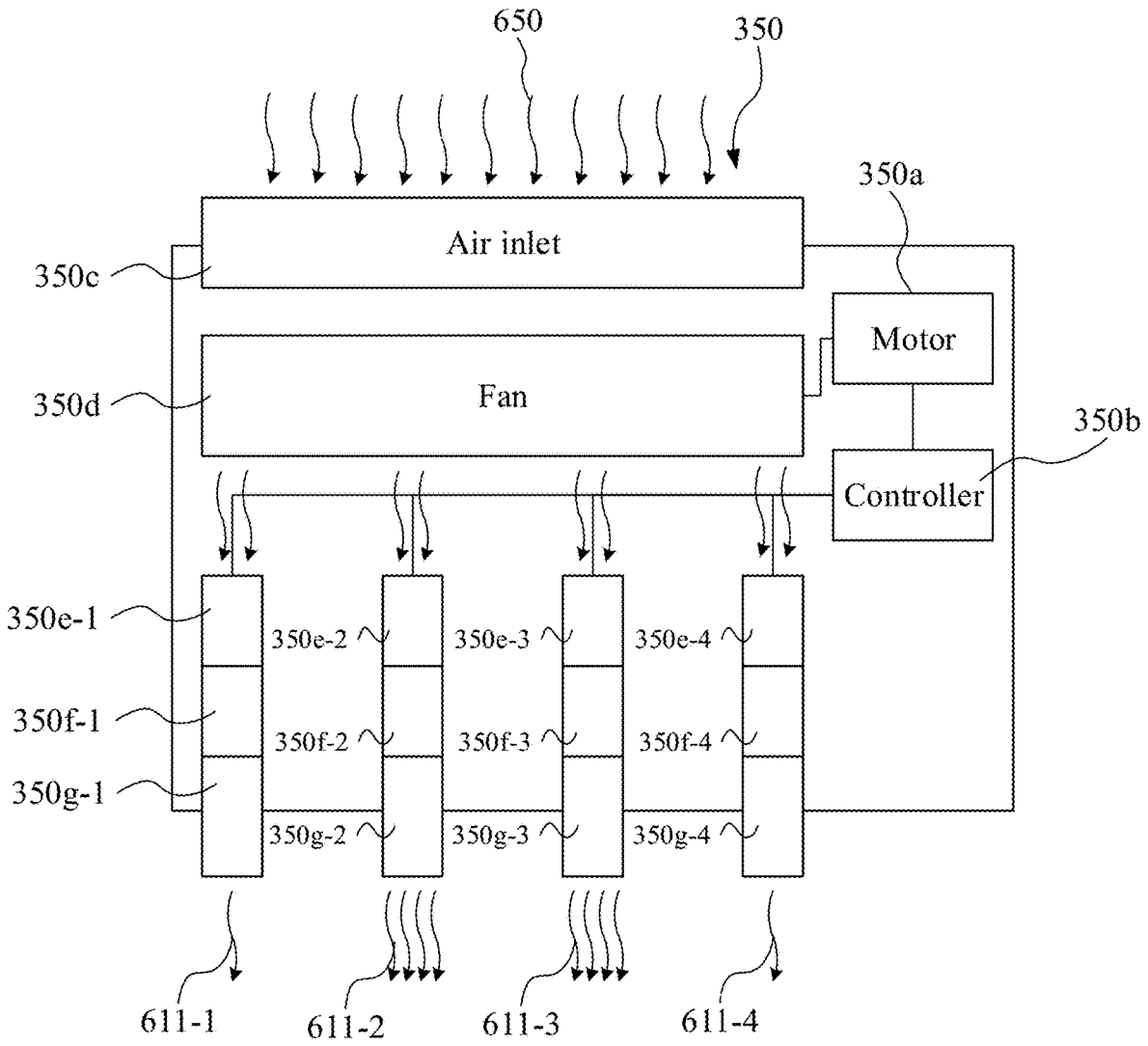
Figure 7C:
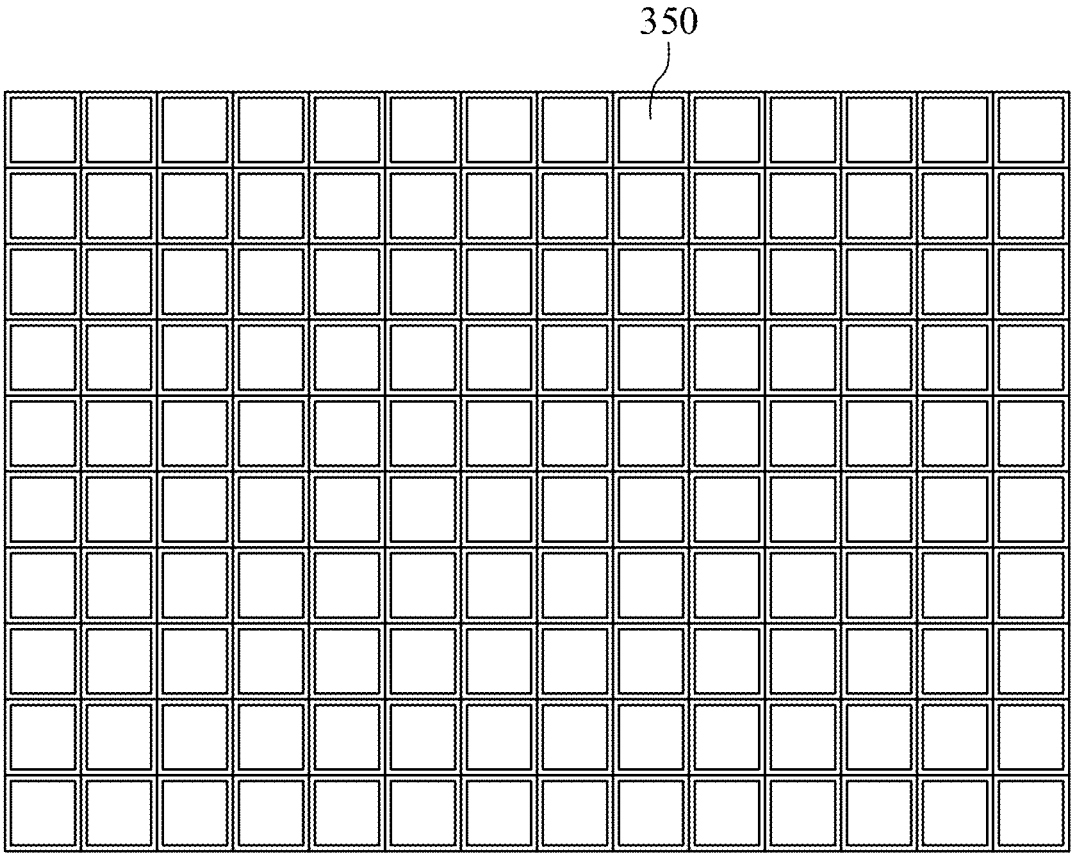
FIG. 7C is a schematic view of peripheral wind outlets device of FIGS. 7A and 7B arranged in a matrix, according to the disclosure.

As shown in FIG. 7B, the peripheral wind outlets device 350 includes: an air inlet 350*c* connected to the ventilation duct 500; a fan 350*d* disposed facing the air inlet 350*c*; a motor 350*a* configured to drive the fan 350*d* to rotate to input air (the wind 650) into the air inlet 350*c*; four throttles 350*e*-1, 350*e*-2, 350*e*-3 and 350*e*-4 disposed on a blowing side of the fan 350*d* and configured to control an air supply volume of the fan 350*d*; four screens 350*f*-1, 350*f*-2, 350*f*-3 and 350*f*-4, disposed on blowing sides of the throttles 350*e*-1, 370*e*-2, 370*e*-3, and 370*e*-4 and configured to uniform the air supply volumes of the throttles 350*e*-1, 370*e*-2, 370*e*-3, and 370*e*-4; four air outlets 350*g*-1, 350*g*-2, 350*g*-3 and 350*g*-4 disposed on blowing sides of the screens 350*f*-1, 370*e*-2, 370*e*-3, and 370*e*-4 and facing the protected space 1; a controller 350*b* connected to the motor 350*a* and the throttles 350*e*-1, 370*e*-2, 370*e*-3 and 370*e*-4. After receiving the wind field control command from the wind field control system 200, the controller 350*b* adjusts a rotation speed of the motor 350*a* and sizes of the throttles 350*e*-1, 350*e*-2, 350*e*-3 and 350*e*-4, to adjust the air-supply wind speeds. The four-in-one peripheral air exhaust device can have the structure the same as that of the four-in-one peripheral wind outlets device, and use multiple air inlets and multiple throttles. Each of the throttles 350*e*-1, 350*e*-2, 350*e*-3 and 350*e*-4 can be fully-open/fully-closed type or adjustable opening-degree type. After the controller 350*b* receives the wind field control command transmitted from the wind field control system 200, the controller 370*b* controls the motor 370*a* and the throttles 370*e*-1, 370*e*-2, 370*e*-3 and 350*e*-4 to make the wind 611-1 of the air outlet 350*g*-1, the wind 611-2 of the air outlet 350*g*-2, the wind 611-3 of the air outlet 350*g*-3 and the wind 611-4 of the air outlet 350*g*-4 different from each other.

Figure 7D:
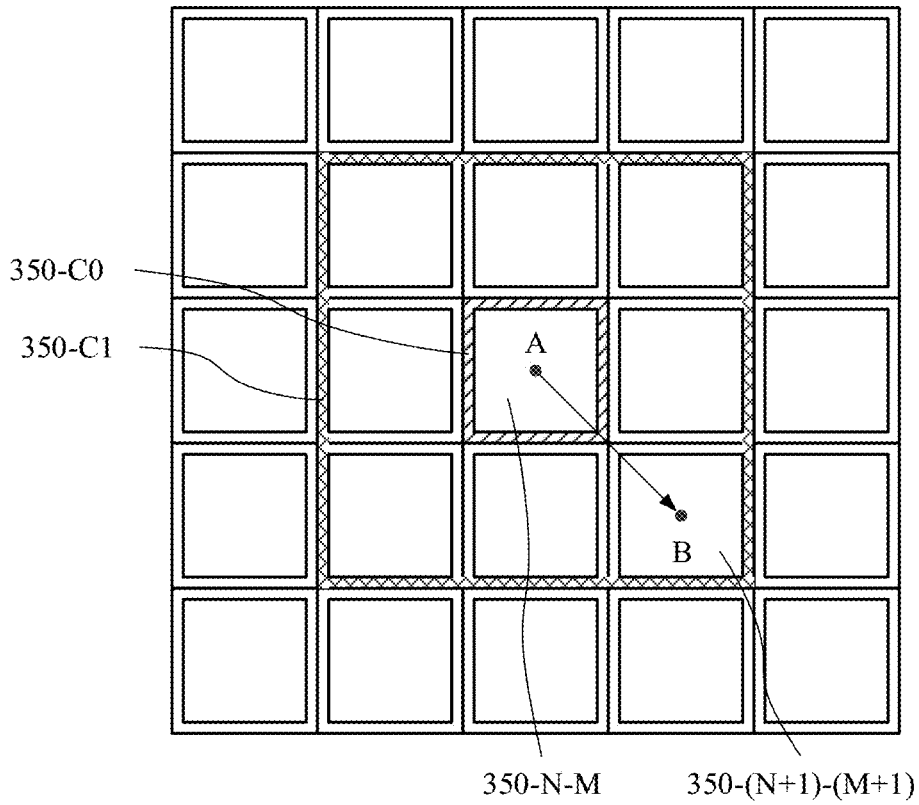
FIGS. 7D and 7E are schematic views of peripheral wind outlets device of a first range circle corresponding to movement of a person, according to the disclosure.
Figure 7E:
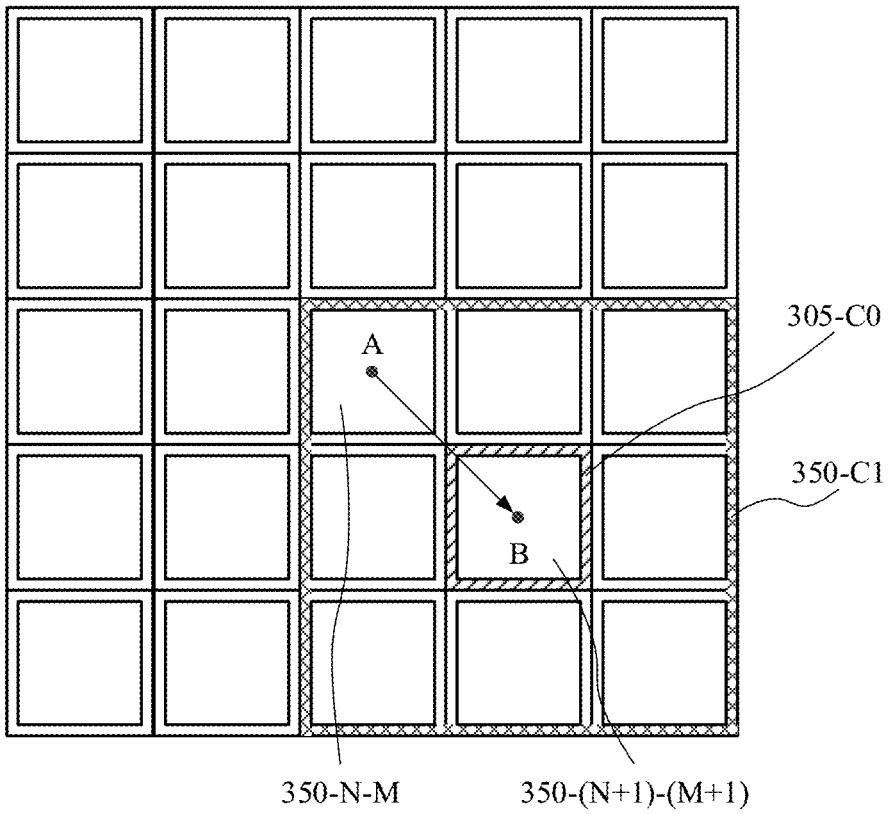

Please refer to FIGS. 7D and 7E, when the center point A of the person range coordinate moves to the center point B, the wind field control system 200 moves the central range circle from the central range circle 350-C0 to the first range circle 350-C1, and moves the central range circle from the air supply device 350N-M to the air supply device 350-(N+1)-(M+1).

Figure 8A:
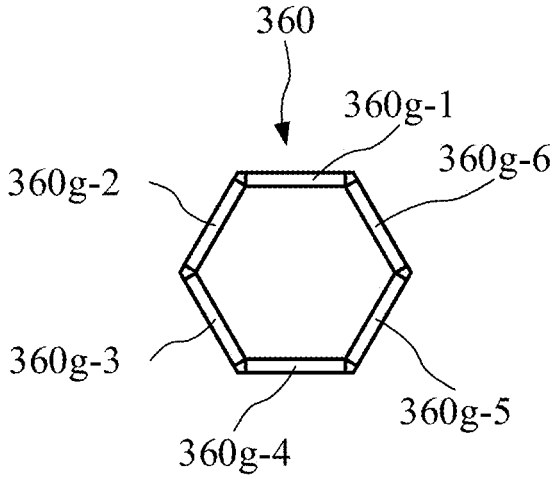
FIG. 8A is a schematic view of a blowing side of a peripheral wind outlets device of the disclosure.
Figure 8B:
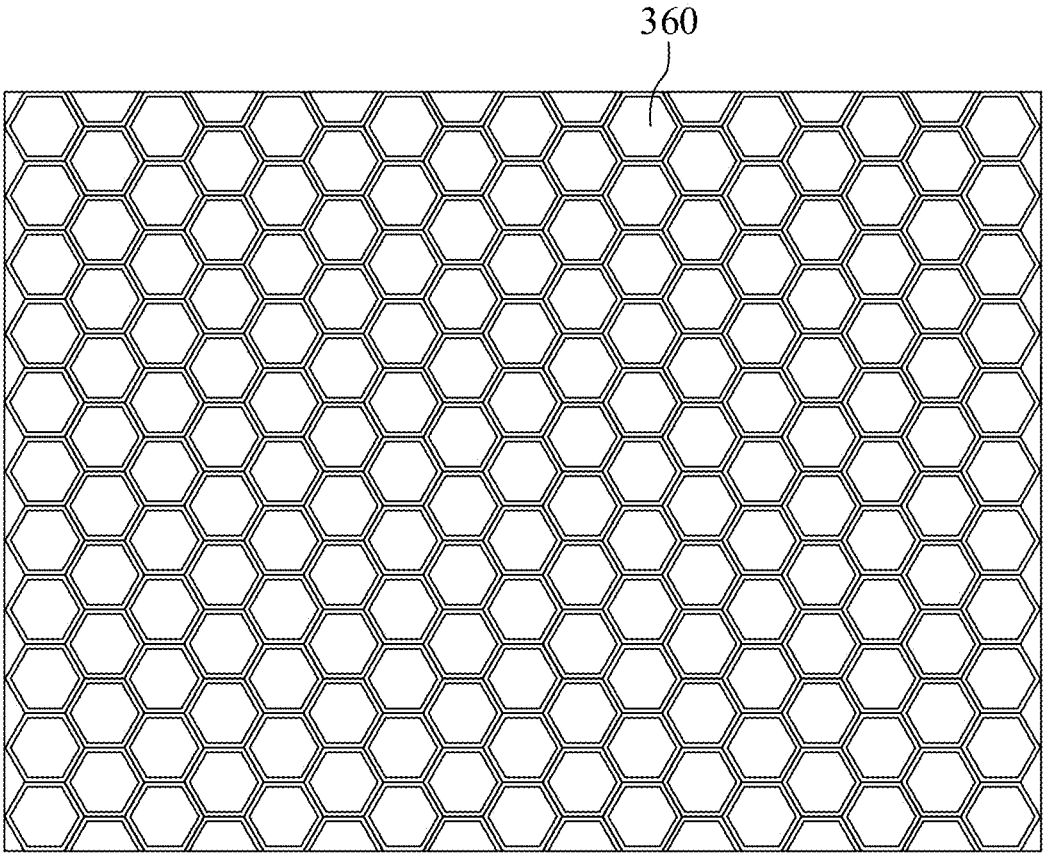
FIG. 8B is a schematic view of the peripheral wind outlets device of FIG. 8A arranged in a matrix, according to the disclosure.
Figure 8C:
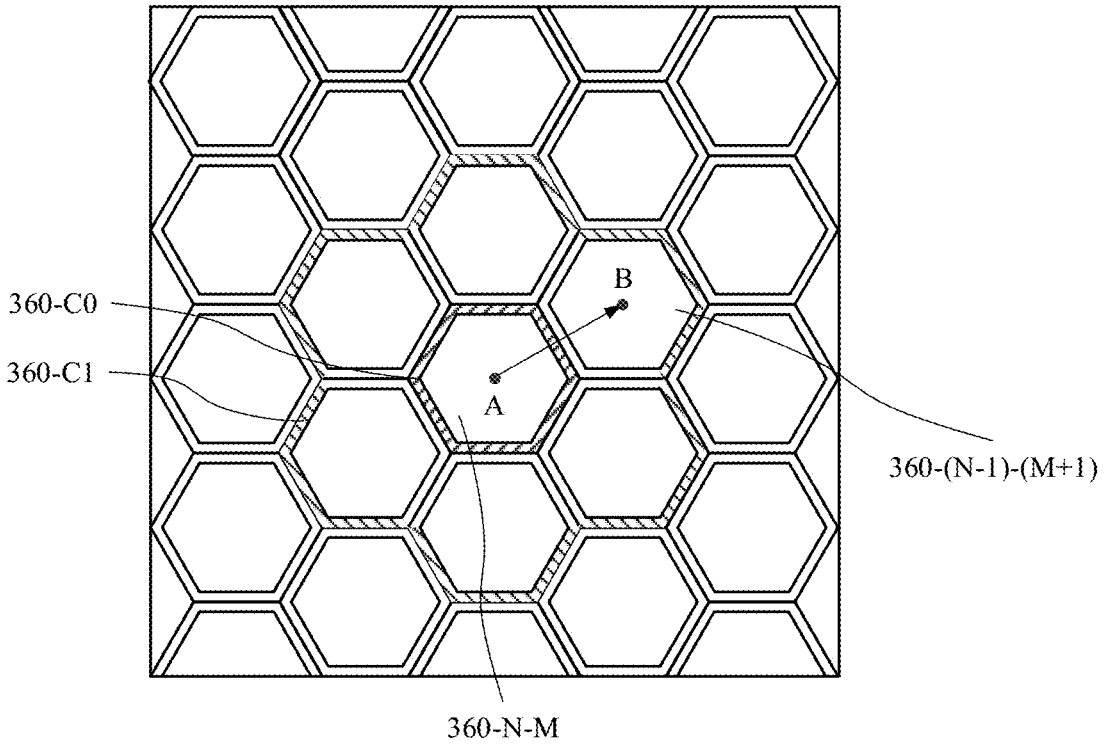
FIGS. 8C and 8D are schematic views of the peripheral wind outlets device of a first range circle corresponding to a movement of a person, according to the disclosure.
Figure 8D:
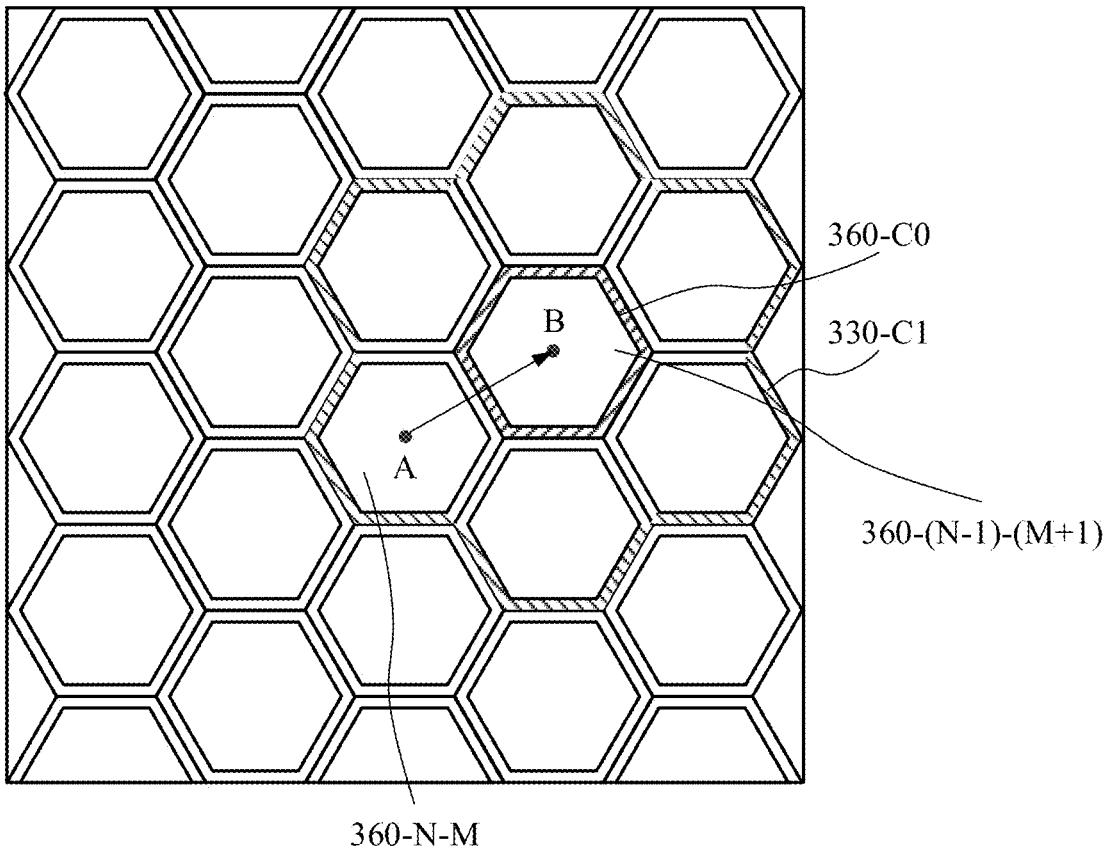

Please refer to FIGS. 8A to 8D, which show the embodiment of the hexagonal peripheral wind outlets device 360 and the method of defining the first range circle, according to the disclosure. The difference between the embodiment of FIG. 7A to 7E and the embodiment of FIG. 8A to 8D is the amount of the air outlets. As shown in FIG. 8A, the hexagonal peripheral wind outlets device 360 includes six air outlets including an air outlet 360*g*-1, an air outlet 360*g*-2, an air outlet 360*g*-3, an air outlet 360*g*-4, an air outlet 360*g*-5 and an air outlet 360*g*-6, and the six air outlets are disposed facing the protected space and arranged in a honeycomb shape, as shown in FIG. 8B. In FIGS. 8C and 8D, when the center point A of the person range coordinate moves to the center point B, the wind field control system 200 moves the central range circle from the central range circle 360-C0 to the first range circle 360-C1, and moves the central range circle from the air supply device 360-N-M to the air supply device 350-(N−1)-(M+1).

According to the above description, the wind field control system 200 of the disclosure can control the matrix wind field generation system based on the person range coordinate of the person identification system 100, and define the first range circle or the central range circle to make the space, where the person 700 is located, under positive pressure or negative pressure.

Some embodiments of control method are described in the following paragraphs to illustrate the method of generating and controlling the positive or negative pressure according to the disclosure.

Figure 9A:
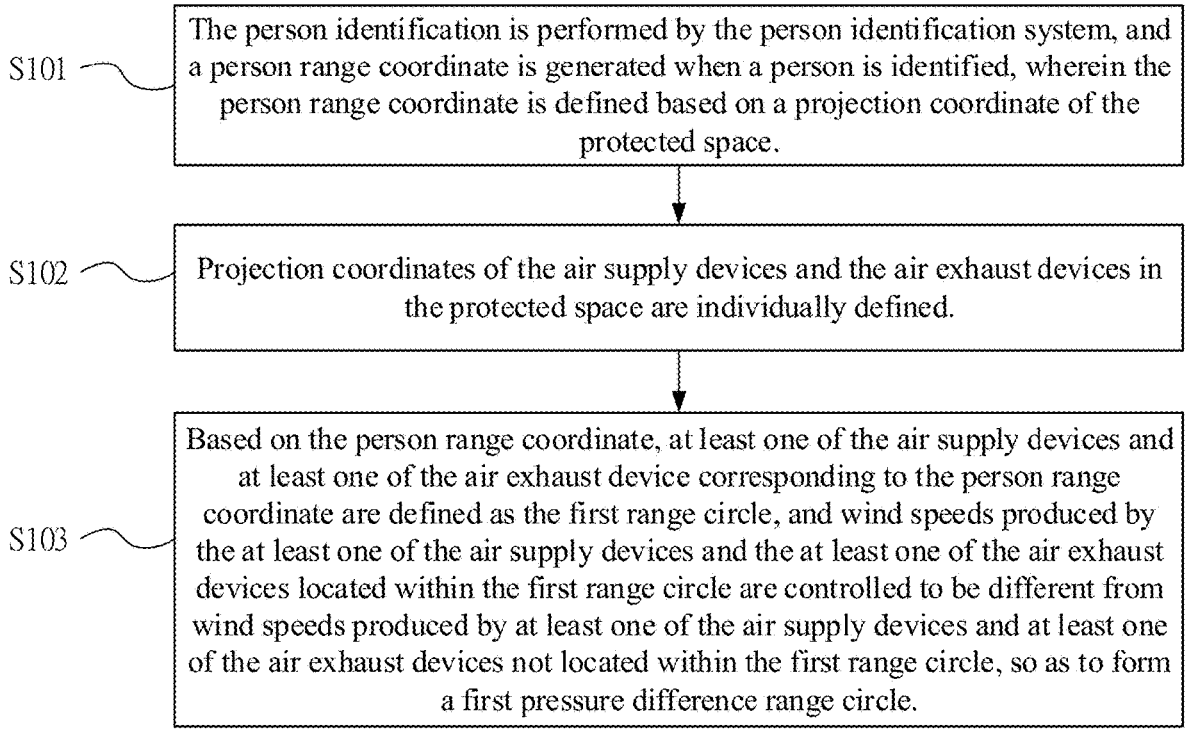
FIGS. 9A to 9C are flowcharts of a first particular embodiment of a method of using a full covered wind outlet devices to generate protective air pressure difference, according to the disclosure.
Figure 9B:
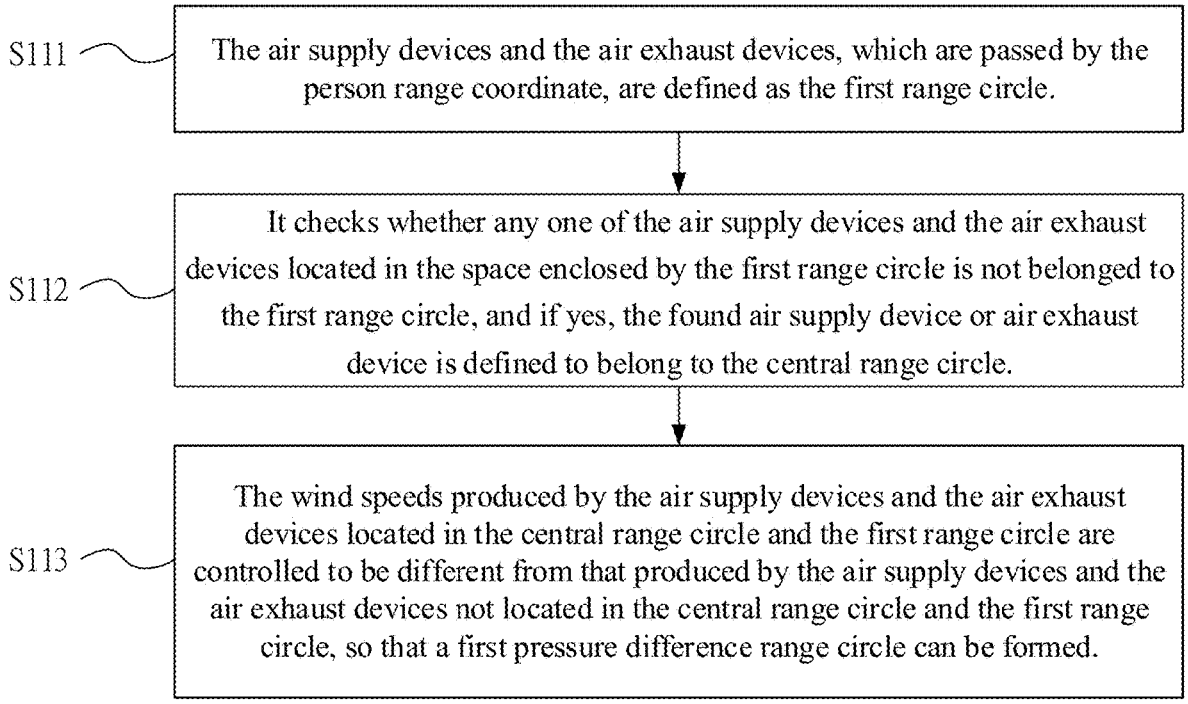
Figure 9C:
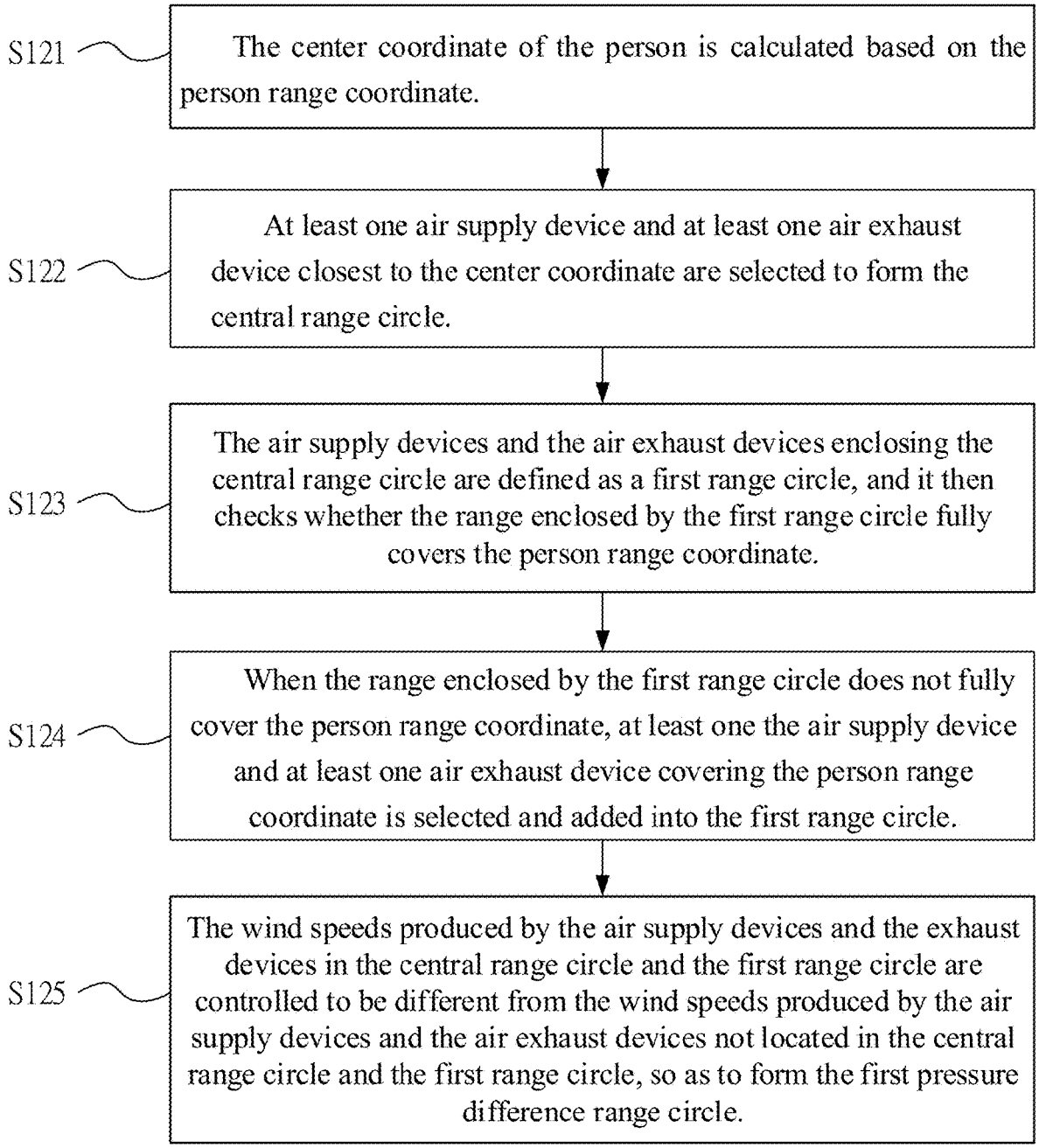

Please refer to FIGS. 9A to 9C, which show the first particular embodiment of a full-covered method of generating protective air pressure difference, according to the disclosure. As shown in FIGS. 9A to 9C, the method includes the following steps.

In a step S101: the person identification is performed by the person identification system, and a person range coordinate is generated when a person is identified, wherein the person range coordinate is defined based on a projection coordinate of the protected space.

In a step 102, projection coordinates of the plurality of air supply devices and the plurality of air exhaust devices in the protected space are individually defined.

In a step 103, based on the person range coordinate, at least one of the plurality of air supply devices and at least one of the air exhaust devices corresponding to the person range coordinate are defined as the first range circle, and wind speeds produced by the at least one of the plurality of air supply devices and the at least one of the plurality of air exhaust devices located within the first range circle are controlled to be different from wind speeds produced by at least one of the plurality of air supply devices and at least one of the plurality of air exhaust devices not located within the first range circle, so as to form a first pressure difference range circle.

The flow shown in FIG. 9A include two main technical features. First, the first range circle is defined based on the person range coordinate (that is, the person range coordinate defining method), the wind speed of the first range circle is controlled to be different from the wind speeds of the spaces other than the first range circle, so as to produce an air pressure difference between the space within the first range circle and the spaces other than the first range circle. The disclosure provides some particular embodiments for defining the first range circle based on the person range coordinate.

An embodiment of defining the first range circle is described according to the flow of FIG. 9B. The air supply devices, which are passed by the person range coordinate, are defined as the first range circle; that is, the person range coordinate is expressed as the boundary coordinates of the object range, and the air supply devices or the air exhaust devices covering the boundary coordinates are belonged to the first range circle. The embodiment of FIG. 9B includes the following steps.

In a step S111, the air supply devices and the air exhaust devices, which are passed by the person range coordinate, are defined as the first range circle.

In a step S112, it checks whether any one of the air supply devices and the air exhaust devices located in the space enclosed by the first range circle is not belonged to the first range circle, and if yes, the found air supply device or air exhaust device is defined to belong to the central range circle. According to the embodiment of FIG. 4F, the person 700 may be enclosed by 6~12 air supply devices, and the outermost range is approximately first range circle; that is, the amount of the air supply devices of the first range circle may be 6, 8, or 10 and the amount of the air supply devices of the central range circle can be 0, 1 or 2. Therefore, in some situations, there may be no central range circle existed when this embodiment is used to define the first range circle.

In a step S113, the wind speeds produced by the air supply devices and the air exhaust devices located in the central range circle and the first range circle are controlled to be different from that produced by the air supply devices and the air exhaust devices not located in the central range circle and the first range circle, so that a first pressure difference range circle can be formed.

The first pressure difference range circle can apply positive pressure or negative pressure upon the application scenario. For example, in a negative pressure ward, the positive pressure environment is applied to a medical worker, and the negative pressure environment is applied to a patient, so as to protect the medical worker; the pressure difference of the second pressure difference range circle is opposite to the pressure difference of the first pressure difference range circle.

For the condition that there is no central range circle, the disclosure further provides several embodiments of controlling the air supply devices of the first range circle to produce positive pressure by the manner of adjusting the air-supply wind speeds and the air-exhaust wind speeds. There are two manners of adjusting the positive pressures in the first range circle. In the first manner, the air-supply wind speeds of the air supply devices and the air-exhaust wind speeds of the air exhaust devices within the first range circle are adjusted to be lower than an initial setting value, and the wind speeds of other air supply devices and other air exhaust devices are set as the initial setting value. In the second manner, the air-supply wind speeds of the air supply devices and the air-exhaust wind speeds of the air exhaust devices not located within the first range circle are adjusted to be higher than the initial setting value. There are two manners of adjusting the negative pressure inside the first range circle includes the following operations. In the first manner, the air-supply wind speeds of the air supply devices and the air-exhaust wind speeds of the air exhaust devices located within the first range circle are adjusted to be higher than the initial setting value. In the second manner, the air-supply wind speeds of the air supply devices and the air-exhaust wind speeds of the air exhaust devices not located within the first range circle are adjusted to be lower than the initial setting value, and the air-supply wind speeds and air-exhaust wind speeds within the first range circle are set as the initial setting value. The first manner is to adjust the wind speeds within the first range circle, the second manner is to adjust the wind speeds not within the first range circle, the targets to be adjusted are different, but their technical effects are the same.

For the condition that there is a central range circle, the disclosure provides several embodiments of controlling the air supply device in the first range circle to produce positive pressure by the manner of adjusting the air-supply wind speed and the air-exhaust wind speed. In the manner of adjusting the positive pressure in the first range circle, the air-supply wind speeds of the air supply devices and the air-exhaust wind speeds of the air exhaust devices within the central range circle and the first range circle are adjusted to be lower than the initial setting value, and the wind speeds of other air supply devices and other air exhaust devices are set as the initial setting value, and the wind speeds within the central range circle is lower than that within the first range circle; that is, the wind speeds within the central range circle is minimum. In the manner of adjusting negative pressure in the first range circle, the air-supply wind speeds of the air supply devices and the air-exhaust wind speeds of the air exhaust devices within the central range circle and the first range circle are adjusted to be higher than the initial setting value, and the wind speeds within the central range circle is higher than that within the first range circle, that is, the wind speeds within the central range circle is maximum. According to the above-mentioned two manners, one is to adjust the wind speed within the first range circle, the other is to adjust the wind speed not within the first range circle, the target to be adjusted are different, but their technical effects are the same.

FIG. 9C shows a flow of another embodiment of defining the first range circle based on the center coordinate. The center coordinate calculated based on the person range coordinate is used to define a range of the first range circle. The embodiment of FIG. 9C includes the following steps.

In a step S121, the center coordinate of the person is calculated based on the person range coordinate.

In a step S122, at least one air supply device and at least one air exhaust device closest to the center coordinate are selected to form the central range circle. As described above, the amount of the air supply devices in the central range circle may be 1, 2 or 4, as shown in FIG. 4F, or may be 1, 2, or 3 as shown in FIGS. 4K and 4L.

In a step S123, the air supply devices and the air exhaust devices enclosing the central range circle are defined as a first range circle, and it then checks whether the range enclosed by the first range circle fully covers the person range coordinate.

In a step S124, when the range enclosed by the first range circle does not fully cover the person range coordinate, at least one the air supply device and at least one air exhaust device covering the person range coordinate is selected and added into the first range circle.

the step S125, the wind speeds produced by the air supply devices and the air exhaust devices in the central range circle and the first range circle are controlled to be different from the wind speeds produced by the air supply devices and the air exhaust devices not located in the central range circle and the first range circle, so as to form the first pressure difference range circle.

According to above-mentioned contents, the first range circles defined the embodiments of FIG. 9B and the embodiment of FIG. 9C may be the same or not. For example, in the embodiment of FIG. 9B, there may be no central range circle, but in the embodiment of FIG. 9C, there must be a central range circle, so different methods of defining the first range circle may obtain the first range circles with the same ranges or different ranges. After the central range circle and the first range circle are defined, the method of producing the positive pressure and the negative pressure are the same as the above-mentioned methods, so the detailed descriptions are not repeated herein.

Figure 10A:
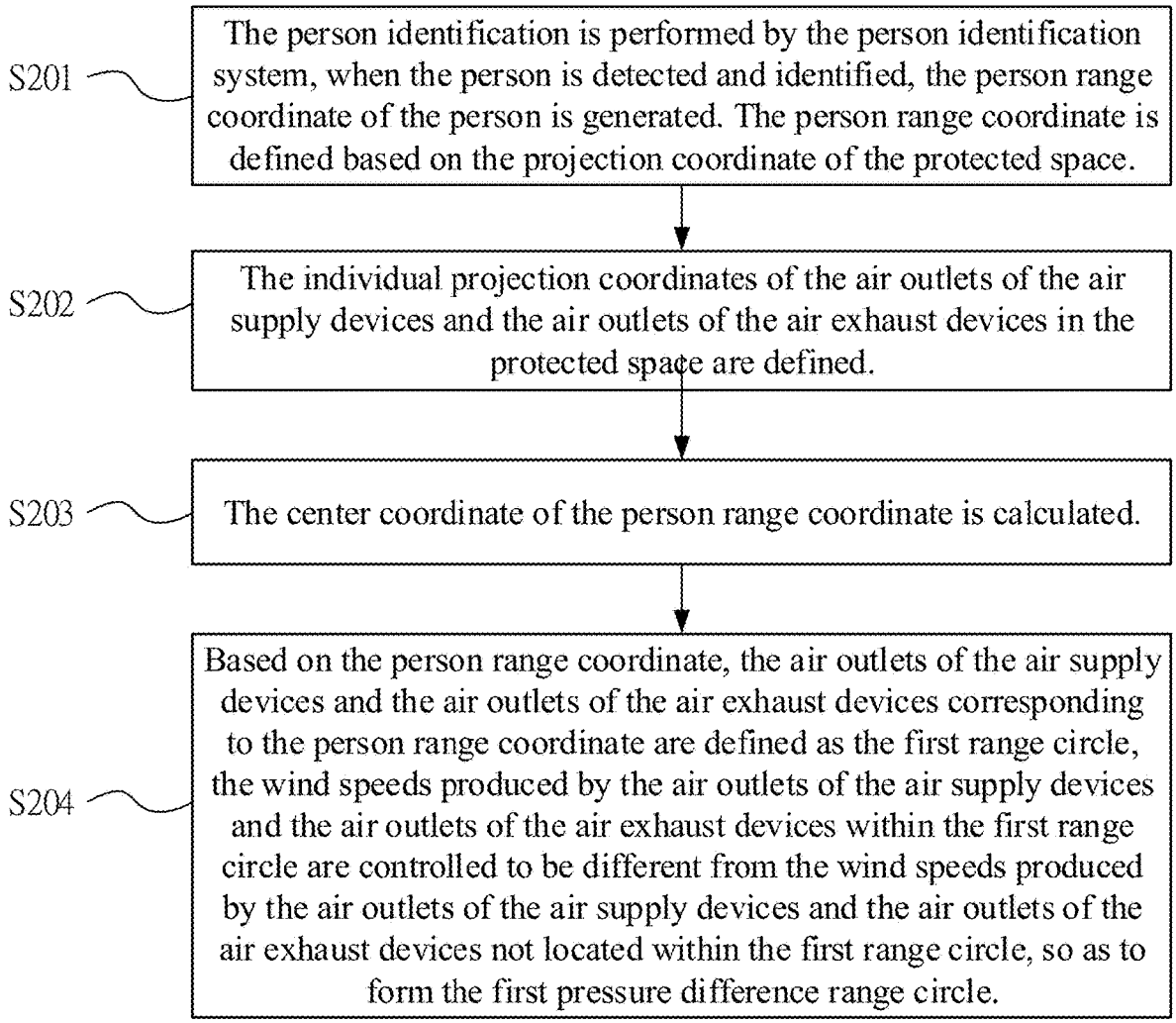
FIGS. 10A to 10D are a flowchart of a first particular embodiment of a method of using peripheral wind outlets device to generate protective air pressure difference, according to the disclosure.

The above-mentioned wind field control method applies the full covered wind outlet devices and the full-covered air exhaust devices. The method of controlling the peripheral wind outlets device and the peripheral air exhaust devices will be illustrated in the following paragraphs. Please refer to FIGS. 10A to 10C, which show the method of generating protective air pressure difference by using peripheral-type devices. The main flow of the method includes the following steps.

In a step S201, the person identification is performed by the person identification system, when the person is detected and identified, the person range coordinate of the person is generated. The person range coordinate is defined based on the projection coordinate of the protected space.

In a step S202, the individual projection coordinates of the air outlets of the air supply devices and the air outlets of the air exhaust devices in the protected space are defined.

In a step S203, the center coordinate of the person range coordinate is calculated. The air outlet configuration of the peripheral wind outlets device is different from that of the full covered wind outlet device, the air outlets of the peripheral wind outlets device are located on peripheral parts of the peripheral wind outlets device, and the air outlet of the full covered wind outlet device is entire surface. Therefore, the center of each air outlet of the peripheral wind outlets device is located at the center of a side of the peripheral wind outlets device, and the center of the air outlet of the full covered wind outlet device is located at the center of the entire surface of the peripheral wind outlets device. When the person range coordinate passes through a peripheral wind outlets device, the person range coordinate may only pass one, two or three of the air outlets, and it is hard to determine whether the passing location is inside or outside the person range coordinate. Therefore, the center coordinate of the person range coordinate can be used as a reference point to more accurately determine the relationship between the air outlets of the peripheral wind outlets device and the person range coordinate.

In a step S204, based on the person range coordinate, the air outlets of the air supply devices and the air outlets of the air exhaust devices corresponding to the person range coordinate are defined as the first range circle, the wind speeds produced by the air outlets of the air supply devices and the air outlets of the air exhaust devices within the first range circle are controlled to be different from the wind speeds produced by the air outlets of the air supply devices and the air outlets of the air exhaust devices not located within the first range circle, so as to form the first pressure difference range circle.

Figure 10B:
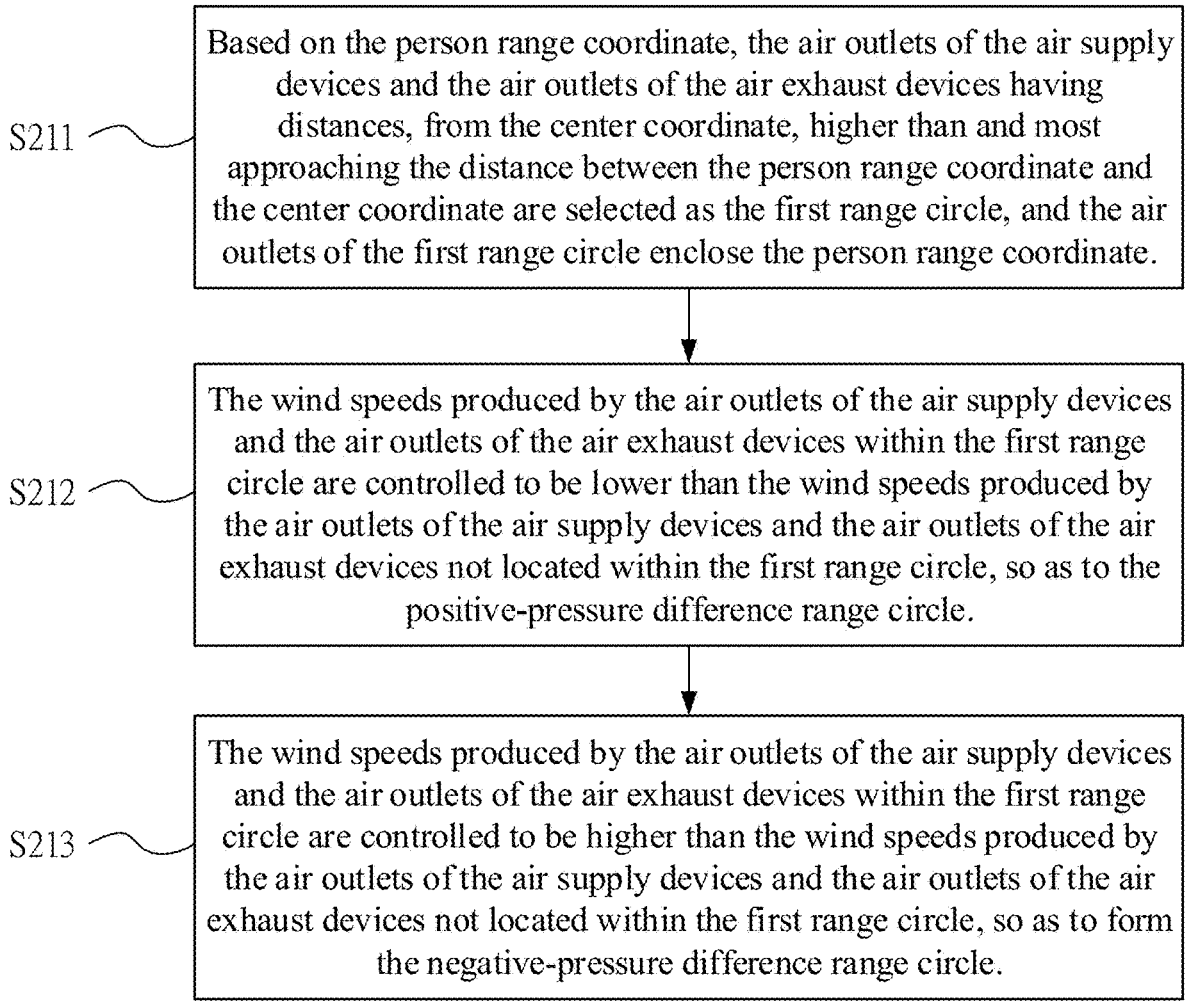

FIG. 10B shows an embodiment of defining the first range circle.

In a step S211, based on the person range coordinate, the air outlets of the air supply devices and the air outlets of the air exhaust devices having distances, from the center coordinate, higher than and most approaching the distance between the person range coordinate and the center coordinate are selected as the first range circle, and the air outlets of the first range circle enclose the person range coordinate. Compared with the full covered wind outlet device capable of enclosing the coordinate range of the person to form an enclosed structure, the peripheral wind outlets device has the air outlets located at the sides thereof, so the air outlets through which the person coordinate range passes may form an open structure and not be connected to each other. Therefore, an embodiment of the disclosure is to form an enclosed structure in which the air outlets are connected to each other.

In a step S212, the wind speeds produced by the air outlets of the air supply devices and the air outlets of the air exhaust devices within the first range circle are controlled to be lower than the wind speeds produced by the air outlets of the air supply devices and the air outlets of the air exhaust devices not located within the first range circle, so as to the positive-pressure difference range circle.

In a step S213, the wind speeds produced by the air outlets of the air supply devices and the air outlets of the air exhaust devices within the first range circle are controlled to be higher than the wind speeds produced by the air outlets of the air supply devices and the air outlets of the air exhaust devices not located within the first range circle, so as to form the negative-pressure difference range circle.

Figure 10C:
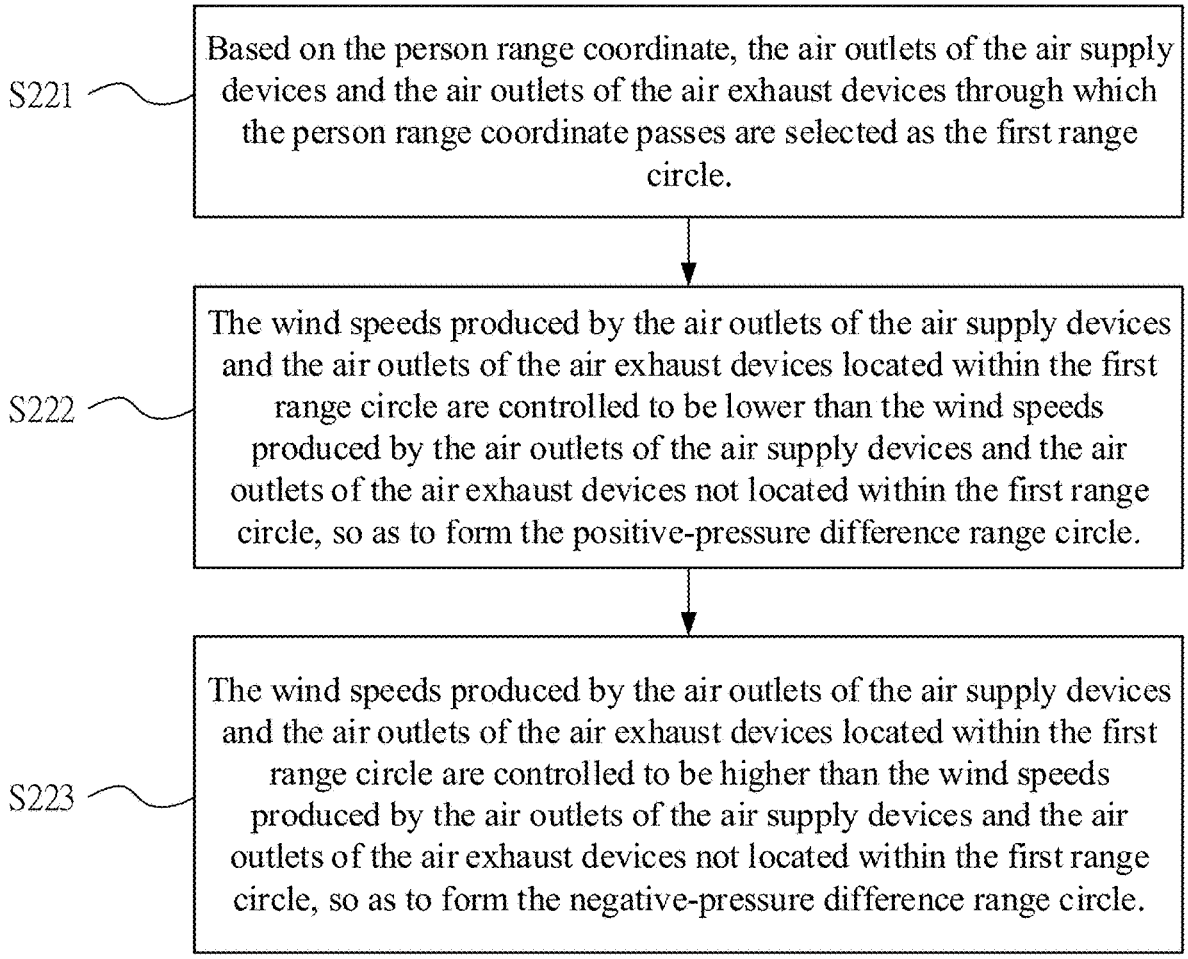

FIG. 10C shows another embodiment of defining the first range circle.

In a step S221, based on the person range coordinate, the air outlets of the air supply devices and the air outlets of the air exhaust devices through which the person range coordinate passes are selected as the first range circle.

In a step S222, the wind speeds produced by the air outlets of the air supply devices and the air outlets of the air exhaust devices located within the first range circle are controlled to be lower than the wind speeds produced by the air outlets of the air supply devices and the air outlets of the air exhaust devices not located within the first range circle, so as to form the positive-pressure difference range circle.

In a step S223, the wind speeds produced by the air outlets of the air supply devices and the air outlets of the air exhaust devices located within the first range circle are controlled to be higher than the wind speeds produced by the air outlets of the air supply devices and the air outlets of the air exhaust devices not located within the first range circle, so as to form the negative-pressure difference range circle.

Figure 10D:
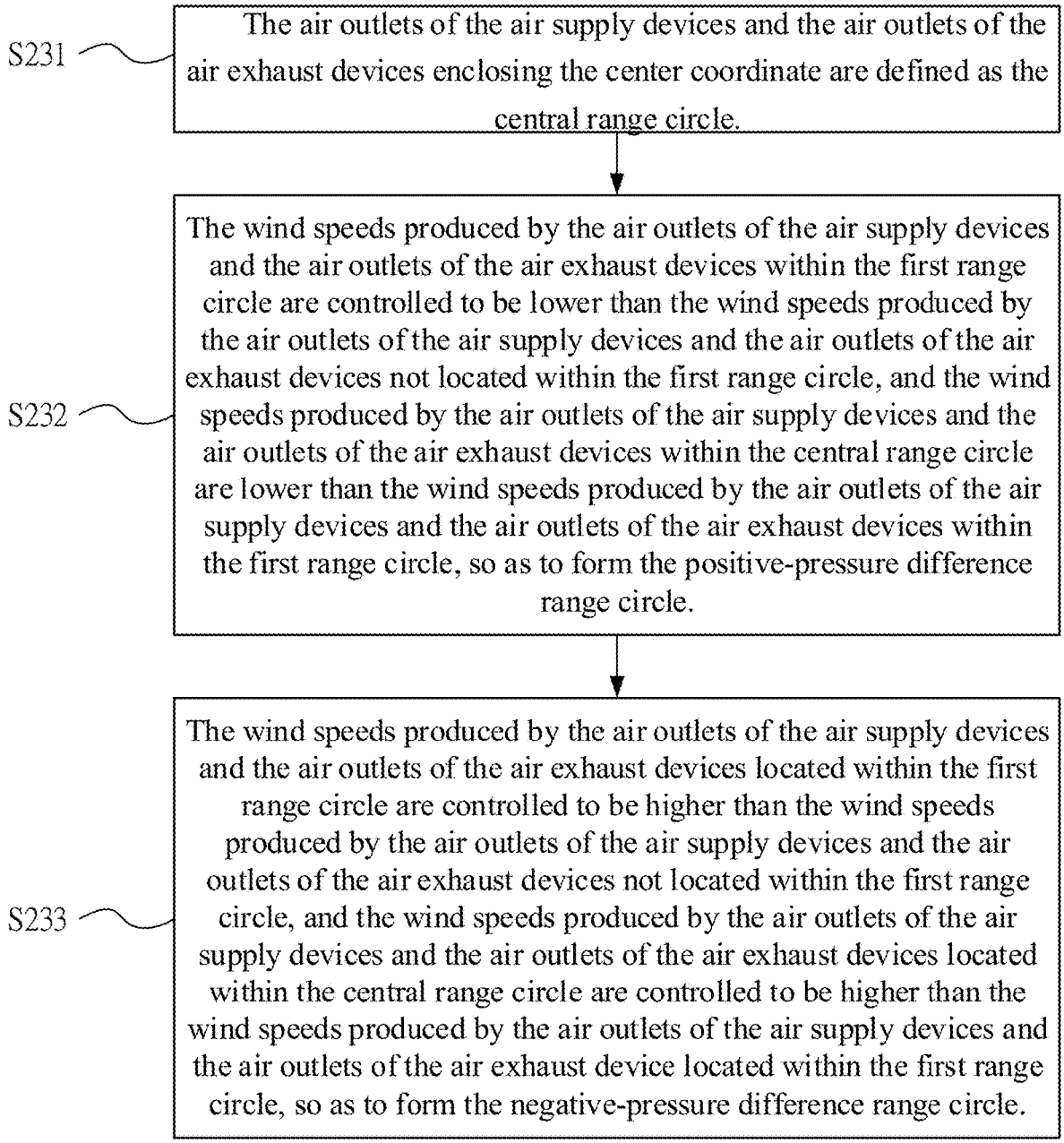

The steps S211~213 and the steps S221~223 are methods of defining the first range circle. Furthermore, the central range circle can be further defined, as shown in FIG. 10D.

In a step S231, the air outlets of the air supply devices and the air outlets of the air exhaust devices enclosing the center coordinate are defined as the central range circle. The central range circle is implemented by the concept of enclosing structure, similar to the steps S211~S213 of the above-described embodiment. Since the center coordinate is a point, the center coordinate may be located at or outside the air outlet of the peripheral wind outlets device. For example, in the embodiment of FIG. 4F, when the center coordinate is just at the air outlet, the amount of the air outlets of the peripheral wind outlets device enclosing the center coordinate may be five or just one, that is, the five air outlets include four air outlets of the peripheral wind outlets device and one adjacent air outlet, and the just one air outlet is the air outlet where the center coordinate is located. When the center coordinate is just located between two air outlets, the amount of the air outlets of the peripheral wind outlets device enclosing the center coordinate is eight to form a close-type enclosed structure, or two to form an open-type enclosing structure. When the center coordinate is just located between the four air outlets, the amount of the air outlets of the peripheral wind outlets device enclosing the center coordinate is four, and so forth. The above-mentioned concept of enclosing structure can be explained by the concept of close-type enclosing structure of steps S111~S113 or the concept of open-type enclosing structure.

In a step S232, the wind speeds produced by the air outlets of the air supply devices and the air outlets of the air exhaust devices within the first range circle are controlled to be lower than the wind speeds produced by the air outlets of the air supply devices and the air outlets of the air exhaust devices not located within the first range circle, and the wind speeds produced by the air outlets of the air supply devices and the air outlets of the air exhaust devices within the central range circle are lower than the wind speeds produced by the air outlets of the air supply devices and the air outlets of the air exhaust devices within the first range circle, so as to form the positive-pressure difference range circle.

In a step S233, the wind speeds produced by the air outlets of the air supply devices and the air outlets of the air exhaust devices located within the first range circle are controlled to be higher than the wind speeds produced by the air outlets of the air supply devices and the air outlets of the air exhaust devices not located within the first range circle, and the wind speeds produced by the air outlets of the air supply devices and the air outlets of the air exhaust devices located within the central range circle are controlled to be higher than the wind speeds produced by the air outlets of the air supply devices and the air outlets of the air exhaust device located within the first range circle, so as to form the negative-pressure difference range circle.

The purpose of the embodiment of the steps S231~S233 is to produce the different wind speeds in the central range circle and the first range circle, to achieve the incremental or decremented wind speeds in the first range circle, or achieve the incremental or decremented wind speeds from the central range circle to the first range circle, and to other space.

Similarly, the steps S231~S233 can control the air outlets not within the first range circle, to control the wind speeds of the air outlets not within the first range circle to be different from the wind speeds of the air outlets within the first range circle. The operations are same as that of the above-mentioned embodiment, so detailed descriptions are not repeated herein.

After the person is detected, the identity of the person (a medical worker or a patient) must be determined, to further determine how to provide air pressure protection to the person. Several embodiments will be illustrated in the following paragraphs.

In an embodiment of the disclosure, only one specific target has a tag (single tag), for example, only one of the medical worker and the patient has the tag according to the concept of either black or white. The particular operations of the embodiment are described in the following paragraphs. When the identified person has a tag, a first pressure difference range circle is formed; when the identified person does not have the tag, at least one of the air supply devices and at least one of the air exhaust devices corresponding to the person range coordinate are selected to form a first range circle, the wind speeds produced by the air supply devices and the air exhaust devices located within the first range circle are controlled to be different from the wind speeds produced by the air supply devices and the air exhaust devices not located within the first range circle, so as to form a second pressure difference range circle, and the second pressure difference range circle is opposite to the first pressure difference range circle on pressure difference.

In another embodiment of the disclosure, two tags are adopted. When the identified person has a first tag, the first pressure difference range circle is formed; when the identified person has a second tag, the second pressure difference range circle is formed, and the second pressure difference range circle is opposite to the first pressure difference range circle on pressure difference.

The tag can be a physical tag (such as a RFID tag), or a software tag produced by the person identification system for identifying a specific person. The software tag is implemented by the person identification system according to, for example, the clothes material (such as protective clothing) of the medical worker and the clothes material (such as cotton clothing) of the patient, so that person identification system can determine the identity of the person and generate the corresponding software tag.

Figure 11:
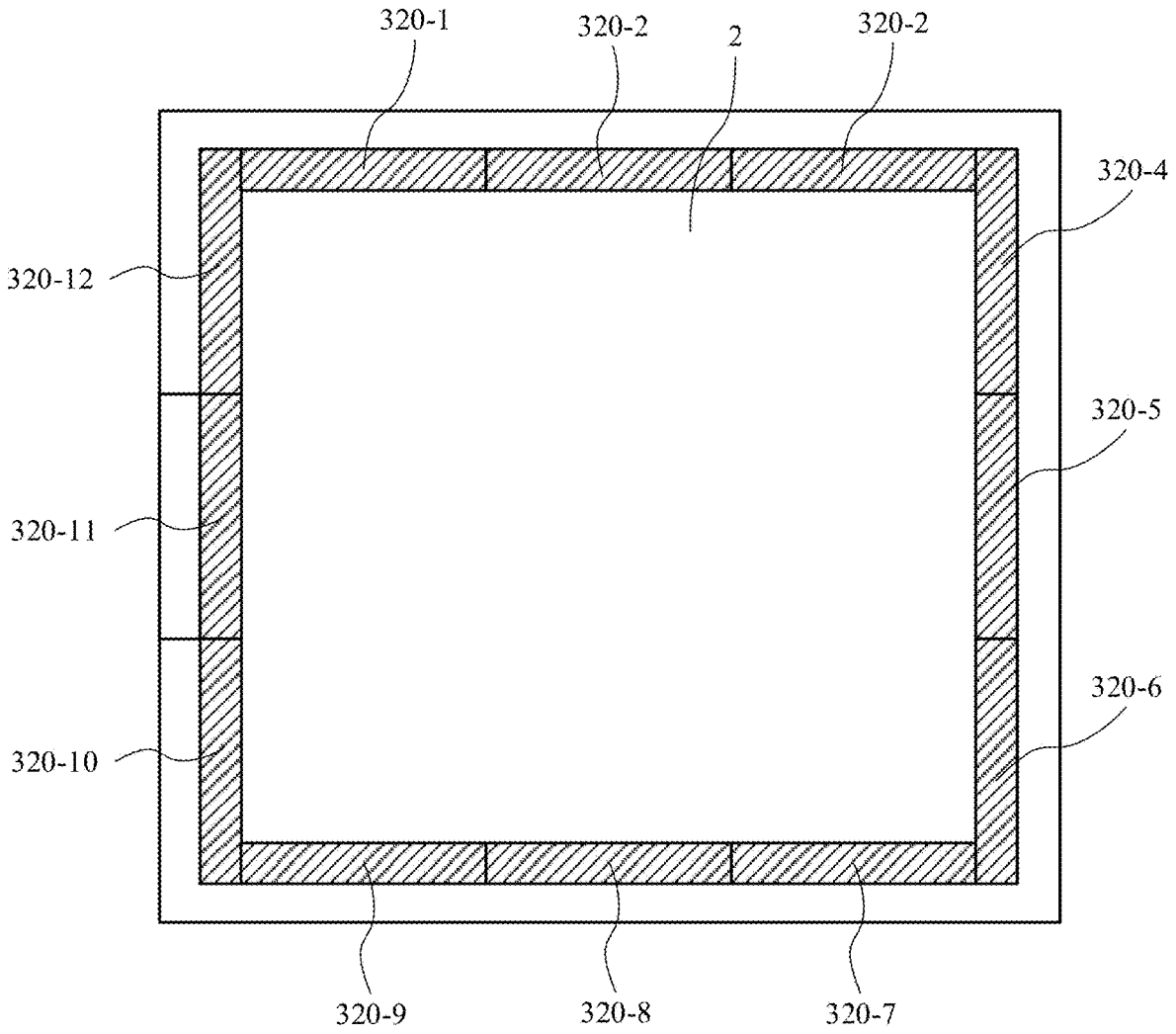
FIG. 11 is another embodiment of the disclosure, an example of the arrangement of the air exhaust matrix provided on the floor 2.

Please refer to FIG. 11, which is another embodiment of the disclosure, an example of the arrangement of the air exhaust matrix provided on the floor 2. From FIG. 11, we can find that the air exhaust device 320-1, air exhaust device 320-2, air exhaust device 320-3, air exhaust device 320-4, air exhaust device 320-5, air exhaust device 320-6, air exhaust device 320-7, air exhaust device 320-8, air exhaust device 320-9, air exhaust device 320-10, air exhaust device 320-11, and air exhaust device 320-12 are all arranged on the periphery of the floor 2 (around the bottom corner of the wall). In some application fields, the air exhaust matrix in the foregoing embodiment is not suitable for disposing the air exhaust device in most of the space of the floor 2 but needs to be configured on the periphery of the floor 2. In addition, the air exhaust device 320-1, the air exhaust device 320-2, the air exhaust device 320-3, etc., may adopt the full-covered air exhaust device or the peripheral air exhaust device descripted above, or a mixture of the two. Similarly, the air supply device in the air supply matrix can also be mixed with the full covered wind outlet device or the peripheral wind outlets device.

In addition, in another embodiment of the disclosure, the air supply matrix can also be arranged on the bottom surface of the protection space 1, and the air exhaust matrix can be arranged on the top surface of the protection space 1. The architecture in FIG. 11 can also be configured in reverse as in this embodiment.

According to the various embodiments, the disclosure identifies the person 700, defines the location range (the first range circle) of the person and produces different wind speeds, to produce different wind barrier on the space where the person is located, to create a protective wind barrier space, thereby implementing the active protection for the medical worker and other person who needs to be protected. The active protection is equivalent to a protective air barrier following and moving with the medical worker. The technical solution of the disclosure is able to apply a protective air barrier on the medical worker in the existing negative pressure ward which is still defective, thereby reducing the possibility of medical worker being infected.

The disclosure disclosed herein has been described by means of specific embodiments. However, numerous modifications, variations and enhancements can be made thereto by those skilled in the art without departing from the spirit and scope of the disclosure set forth in the claims.

What is claimed is:

1. An air supply matrix, composed by a plurality of peripheral wind outlets devices, disposed on a top surface of a protected space, each of the plurality of peripheral wind outlets devices comprising:

an air inlet, connected to a ventilation duct;

a fan, disposed facing the air inlet;

a motor, configured to drive the fan to rotate to input air into the air inlet;

a plurality of throttles, disposed on a blowing side of the fan and configured to control an air supply volume of the fan;

a plurality of screens, disposed on blowing sides of the throttles and configured to uniform the air supply volume of the throttles;

a plurality of air outlets, disposed on a peripheral of blowing sides of the screens and facing the protected space; and a controller, connected to the motor and the throttles, after receiving a wind field control command from a wind field control system, the controller adjusts a rotation speed of the motor and sizes of the plurality of throttles, to adjust air-supply wind speeds;

wherein, each of the plurality of peripheral wind outlets devices has an air supply device coordinate, and the plurality of peripheral wind outlets devices receives a wind field control command provided by a matrix wind field generation system, and the wind field control command includes at least one first range circle and some of the plurality of peripheral wind outlets devices are selected and included in the at least one first range circle, when the air supply device coordinate of one of the plurality of peripheral wind outlets devices is located in the at least one first range circle, the wind speed of one of the plurality of peripheral wind outlets devices is controlled different from those not included in the at least one first range circle, wherein a shape of the plurality of air outlets are selected from: square, triangle, hexagon, diamond and circle.

2. The air supply matrix according to claim 1, wherein each of the plurality of throttles is a fully-open/fully-closed type or an adjustable open-degree type.

* * * * *